US009699877B2

(12) United States Patent
Hori et al.

(10) Patent No.: US 9,699,877 B2
(45) Date of Patent: Jul. 4, 2017

(54) EXTREME ULTRAVIOLET LIGHT GENERATION APPARATUS INCLUDING TARGET DROPLET JOINING APPARATUS

(71) Applicant: GIGAPHOTON INC., Tochigi (JP)

(72) Inventors: Tsukasa Hori, Oyama (JP); Fumio Iwamoto, Oyama (JP); Hiroshi Umeda, Oyama (JP)

(73) Assignee: GIGAPHOTON INC., Tochigi (JP)

( * ) Notice: Subject to any disclaimer, the term of this patent is extended or adjusted under 35 U.S.C. 154(b) by 0 days.

(21) Appl. No.: 15/096,769

(22) Filed: Apr. 12, 2016

(65) Prior Publication Data

US 2016/0227638 A1 Aug. 4, 2016

Related U.S. Application Data

(63) Continuation of application No. PCT/JP2013/080076, filed on Nov. 7, 2013.

(51) Int. Cl.
*H05G 2/00* (2006.01)

(52) U.S. Cl.
CPC ..... *H05G 2/006* (2013.01); *H05G 2/005* (2013.01); *H05G 2/008* (2013.01)

(58) Field of Classification Search
CPC ..... H05G 2/008; H05G 2/003; H05G 2/005; H05G 2/006; G03F 7/70033
See application file for complete search history.

(56) References Cited

U.S. PATENT DOCUMENTS

| | | | |
|---|---|---|---|
| 7,405,413 | B2 | 7/2008 | Hergenhan et al. |
| 7,608,846 | B2 | 10/2009 | Nakano |
| 7,838,845 | B2 | 11/2010 | Abe et al. |
| 8,158,960 | B2 | 4/2012 | Vaschenko et al. |

(Continued)

FOREIGN PATENT DOCUMENTS

| | | |
|---|---|---|
| JP | 2006-074005 A | 3/2006 |
| JP | 2007-200615 A | 8/2007 |

(Continued)

OTHER PUBLICATIONS

International Search Report; PCT/JP2013/080076 mailed Dec. 10, 2013.
Written Opinion; PCT/JP2013/080076 mailed Dec. 10, 2013.

*Primary Examiner* — Brooke Purinton
(74) *Attorney, Agent, or Firm* — Studebaker & Brackett PC

(57) ABSTRACT

In an example of the present invention is an extreme ultraviolet light generation apparatus including: a droplet supply device configured to successively supply droplets; a charging electrode being configured to control charging of droplets supplied from the droplet supply unit; and a target controller configured to control electric polarities of the droplets supplied from the droplet supply unit by controlling potential of the charging electrode in such a way that successive droplets join together to become a target droplet, wherein the droplets controlled in charging by the charging electrode include a plurality of groups each composed of successive droplets, and, in each of the groups, a droplet at one end is charged positively or negatively, a droplet at the other end is uncharged or charged in a polarity being the same as a polarity of an adjacent droplet in a group adjacent to the droplet at the other end.

9 Claims, 20 Drawing Sheets

(56) References Cited

U.S. PATENT DOCUMENTS

| | | | | |
|---|---|---|---|---|
| 2006/0024216 | A1 | 2/2006 | Hergenhan et al. | |
| 2006/0192153 | A1 | 8/2006 | Bykanov et al. | |
| 2006/0192154 | A1* | 8/2006 | Algots | H05G 2/003 250/504 R |
| 2006/0192155 | A1 | 8/2006 | Algots et al. | |
| 2006/0255298 | A1 | 11/2006 | Bykanov et al. | |
| 2007/0170377 | A1 | 7/2007 | Nakano | |
| 2007/0228301 | A1 | 10/2007 | Nakano | |
| 2008/0283776 | A1 | 11/2008 | Algots et al. | |
| 2009/0272919 | A1* | 11/2009 | Abe | G03F 7/70033 250/504 R |
| 2010/0019173 | A1* | 1/2010 | Someya | H05G 2/006 250/496.1 |
| 2011/0284774 | A1 | 11/2011 | Ishihara et al. | |
| 2012/0104289 | A1* | 5/2012 | Mizoguchi | H05G 2/008 250/504 R |
| 2012/0175533 | A1* | 7/2012 | Moriya | H05G 2/008 250/504 R |
| 2013/0077070 | A1* | 3/2013 | Schimmel | G03F 7/70916 355/67 |
| 2015/0002830 | A1 | 1/2015 | Schimmel et al. | |

FOREIGN PATENT DOCUMENTS

| | | | |
|---|---|---|---|
| JP | 2007-266234 | A | 10/2007 |
| JP | 2008-532286 | A | 8/2008 |
| JP | 5156192 | B2 | 3/2013 |
| WO | 2010/137625 | A1 | 12/2010 |
| WO | 2013/029902 | A1 | 3/2013 |

* cited by examiner

COMPARATIVE EXAMPLE

EXTREME ULTRAVIOLET LIGHT GENERATION APPARATUS INCLUDING TARGET DROPLET JOINING APPARATUS

CROSS-REFERENCE TO RELATED APPLICATIONS

The present application is a continuation application of International Application No. PCT/JP2013/080076 filed on Nov. 7, 2013. The content of the application is incorporated herein by reference in its entirety.

BACKGROUND

1. Technical Field

The present disclosure relates to an extreme ultraviolet light generation apparatus and a control method for the extreme ultraviolet light generation apparatus.

2. Related Art

In recent years, semiconductor production processes have become capable of producing semiconductor devices with increasingly fine feature sizes, as photolithography has been making rapid progress toward finer fabrication. In the next generation of semiconductor production processes, microfabrication with feature sizes at 70 nm to 45 nm, and further, microfabrication with feature sizes of 32 nm or less will be required. In order to meet the demand for microfabrication with feature sizes of 32 nm or less, for example, an exposure apparatus is needed in which a system for generating extreme ultraviolet (EUV) light at a wavelength of approximately 13 nm is combined with a reduced projection reflective optical system.

Three kinds of systems for generating EUV light are known in general, which include a Laser Produced Plasma (LPP) type system in which plasma is generated by irradiating a target material with a laser beam, a Discharge Produced Plasma (DPP) type system in which plasma is generated by electric discharge, and a Synchrotron Radiation (SR) type system in which orbital radiation is used to generate plasma.

CITATION LIST

Patent Literature

PTL1: U.S. Pat. No. 7,405,413
PTL2: U.S. Pat. No. 7,838,845
PTL3: U.S. Pat. No. 8,158,960
PTL4: WO 2013/029902 A
PTL5: Japanese Patent No. 5156192
PTL6: WO 2010/137625 A
PTL7: U.S. Pat. No. 7,608,846

SUMMARY

An example of the present invention is an extreme ultraviolet light generation apparatus configured to create a target droplet by joining successive droplets and irradiate the target droplet with a pulse laser beam in a plasma generation region to generate extreme ultraviolet light, the extreme ultraviolet light generation apparatus including: a droplet supply device configured to contain a droplet material and successively supply droplets; a charging electrode disposed between the droplet supply device and the plasma generation region, the charging electrode being configured to control charging of droplets supplied from the droplet supply unit; and a target controller configured to control electric polarities of the droplets supplied from the droplet supply unit by controlling potential of the charging electrode in such a way that successive droplets join together to become a target droplet, wherein the droplets controlled in charging by the charging electrode include a plurality of groups each composed of successive droplets, and, in each of the groups, a droplet at one end is charged positively or negatively, a droplet at the other end is uncharged or charged in a polarity being the same as a polarity of an adjacent droplet in a group adjacent to the droplet at the other end, and the successive droplets join together utilizing a change in speed caused by Coulomb force of the droplet at the one end to become a target droplet.

Another example of the present invention is an extreme ultraviolet light generation apparatus configured to irradiate a target droplet with a pulse laser beam in a plasma generation region to generate extreme ultraviolet light, the extreme ultraviolet light generation apparatus including: a droplet supply device configured to contain a droplet material and successively supply droplets; a charging electrode disposed between the droplet supply device and the plasma generation region, the charging electrode being configured to control charging of droplets supplied from the droplet supply unit; a collecting electrode configured to control movement of the droplets charged by the charging electrode with Coulomb force by being applied a collecting potential; a target controller configured to control potential of the collecting electrode and potential of the charging electrode; and a collecting tank configured to collect droplets controlled in movement by the collecting electrode before the droplets reach the plasma generation region.

Another example of the present invention is a control method for an extreme ultraviolet light generation apparatus configured to create a target droplet by joining successive droplets and irradiate the target droplet with a pulse laser beam in a plasma generation region to generate extreme ultraviolet light, the extreme ultraviolet light generation apparatus including: a droplet supply device configured to contain a droplet material and successively supplying droplets; and a charging electrode disposed between the droplet supply device and the plasma generation region, the charging electrode being configured to control charging of droplets supplied from the droplet supply unit, the control method including: a first step of charging a last droplet in a first group composed of successive droplets ejected from the droplet supply device in a first polarity with the charging electrode; a second step of not charging or charging a first droplet in a second group composed of successive droplets including a droplet next to the last droplet in the first polarity with the charging electrode; a third step of charging a last droplet in the second group in a second polarity opposite to the first polarity with the charging electrode; and a step of repeating the first step to the third step.

Another example of the present invention is a control method for an extreme ultraviolet light generation apparatus configured to irradiate a target droplet with a pulse laser beam in a plasma generation region to generate extreme ultraviolet light, the control method including: charging droplets successively ejected from a droplet supply device containing a droplet material by applying a predetermined potential to a charging electrode; controlling movement of the charged droplets with Coulomb force by applying a collecting potential to a collecting electrode; and collecting droplets controlled in movement by the collecting electrode into a collecting tank before reaching the plasma generation region.

BRIEF DESCRIPTION OF THE DRAWINGS

Hereinafter, selected embodiments of the present disclosure will be described with reference to the accompanying drawings.

DETAILED DESCRIPTION

<Contents>

Figure 1:
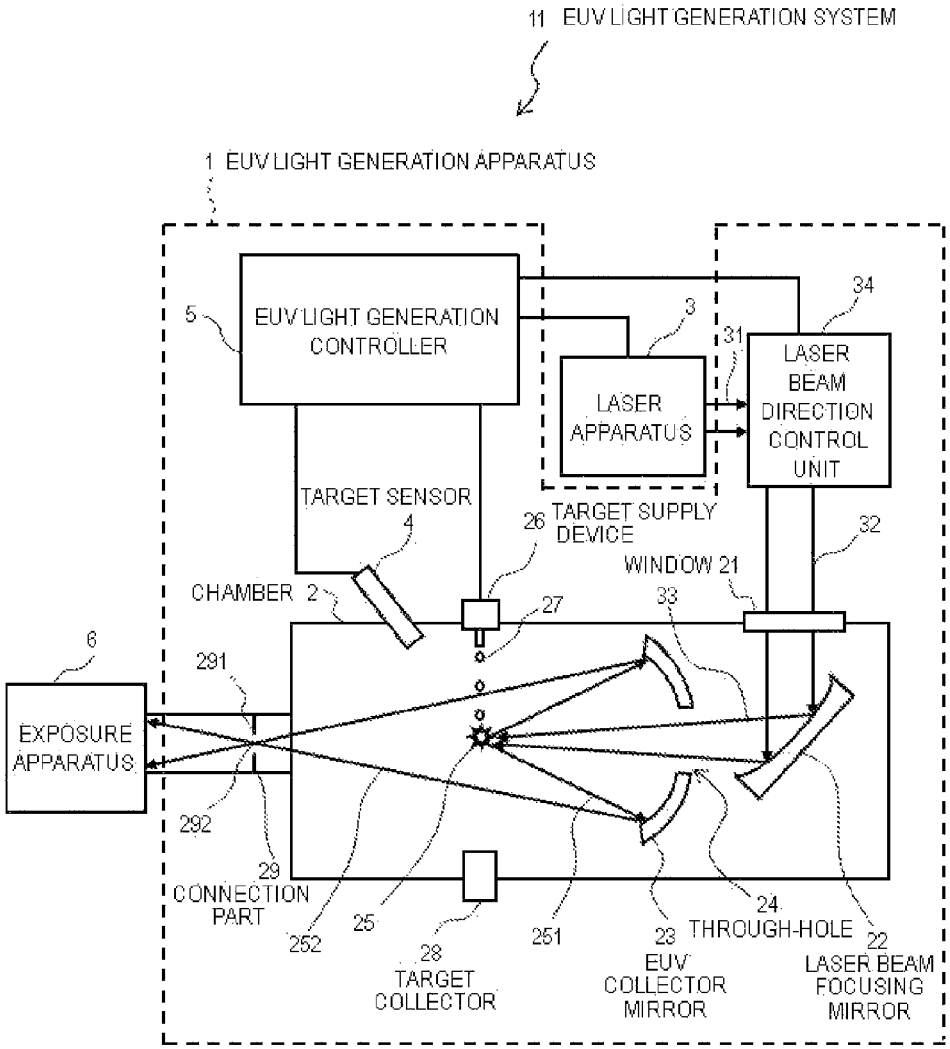
FIG. 1 schematically illustrates an exemplary configuration of an LPP type EUV light generation system.

1. Overview
2. Terms
3. Overview of EUV Light Generation System
   3.1 Configuration
   3.2 Operation
4. Comparative Example of Target Producing Unit
   4.1 Configuration
   4.2 Operation
   4.3 Issues
5. Target Producing Unit Including Charging Electrode
   5.1 Configuration
   5.2 Operation
   5.3 Effects
   5.4 Operation Pattern in Steady Operation
   5.5 Operation Patterns in Ejection Starting Period and Ejection Stopping Period
   5.6 Target Producing Unit Including Accelerating Electrode
   5.7 Target Producing Unit Including Neutralizer
6. Target Producing Unit Including Collecting Electrode for Collecting Charged Droplets
   6.1 Configuration Example 1
   6.2 Configuration Example 2

Hereinafter, selected embodiments of the present disclosure will be described in detail with reference to the accompanying drawings. The embodiments to be described below are merely illustrative in nature and do not limit the scope of the present disclosure. Further, the configuration(s) and operation(s) described in each embodiment are not all essential in implementing the present disclosure. Note that like elements are referenced by like reference numerals and characters, and duplicate descriptions thereof will be omitted herein.

1. Overview

An LPP type EUV light generation system may generate EUV light by irradiating target droplets with a laser beam outputted from a laser apparatus to change the target droplets into plasma. The LPP type EUV light generation system for an exposure apparatus may generate laser beam pulses at a high cyclic frequency of 50 to 100 kHz or higher to irradiate target droplets.

For an LPP type EUV light generation system, it may be important to produce target droplets having an intended diameter with an intended interval. Specifically, producing target droplets having an intended diameter of, for example, approximately 10 μm to 30 μm may be important to improve the conversion efficiency and to prevent generation of debris because of irradiation with a pulse laser beam. Furthermore, producing target droplets with an interval of, for example, approximately 500 μm to 1000 μm may be important to prevent a next target droplet from being affected when plasma is generated.

In a case where droplets are ejected from a droplet supply device obliquely with respect to the direction of gravity, the moving directions of the droplets may be unstably different when the droplet supply device has just started ejection of droplets and when the droplet supply device is stopping the ejection of droplets, so that the droplets might drop on the surface of an EUV collector mirror.

In one aspect of the present disclosure, the EUV light generation apparatus may control the potential of a charging electrode to control the electric polarities of droplets successively supplied from a droplet supply device so that the droplets will join together to become a target droplet. In each group composed of some successive droplets, the droplet at one end is charged positively or negatively; the droplet at the other end is uncharged or charged with the same polarity as an adjacent droplet in a group adjacent to the droplet at the other end. The successive droplets may join together to become a target droplet by utilizing the change in speed of the droplet at the one end caused by the Coulomb force.

In the one aspect of the present disclosure, the EUV light generation apparatus may control a charging electrode to appropriately charge the droplets ejected from the droplet supply device to join a plurality of successive droplets into a target droplet having an intended diameter and supply the target droplet to the plasma generation region at an intended interval.

In another aspect of the present disclosure, the EUV light generation apparatus may include a charging electrode for controlling charging the droplets supplied from a droplet supply device, a collecting electrode for controlling the motion of the droplets electrified by the charging electrode with the Coulomb force, a target controller for controlling the potentials of the collecting electrode and the charging electrode, and a collecting tank for collecting the droplets controlled in motion by the collecting electrode before the droplets reach the plasma generation region.

In the other aspect of the present disclosure, the EUV light generation apparatus may charge the droplets ejected in unstably different directions to collect the droplets with the Coulomb force, preventing the droplets from being attached to an undesirable part.

2. Terms

Terms used in the present disclosure will be described hereinafter. A "target" may refer to a droplet for generating EUV light, which turns into plasma by being irradiated with a pulse laser beam. A "target" may also be expressed as "target droplet". The "target droplet" may refer to a droplet ejected from a droplet supply device and not join with another droplet or otherwise, a droplet produced by joining a plurality of droplets. The "target droplet" may be a kind of droplet.

A "plasma generation region" may refer to a region where the generation of plasma for generating EUV light begins. It may be necessary for a target to be supplied to the plasma generation region and for a pulse laser beam to be focused at the plasma generation region at the timing at which the target reaches the plasma generation region in order for the generation of plasma to begin at the plasma generation region.

3. Overview of EUV Light Generation System

3.1 Configuration

FIG. 1 schematically illustrates an exemplary configuration of an LPP type EUV light generation system. An EUV light generation apparatus 1 may be used with at least one laser apparatus 3. Hereinafter, a system that includes the EUV light generation apparatus 1 and the laser apparatus 3 may be referred to as an EUV light generation system 11. As shown in FIG. 1 and described in detail below, the EUV light generation system 11 may include a chamber 2 and a target supply device 26.

The chamber 2 may be sealed airtight. The target supply device 26 may be mounted onto the chamber 2, for example, to penetrate a wall of the chamber 2. A target material to be supplied by the target supply device 26 may include, but is not limited to, tin, terbium, gadolinium, lithium, xenon, or any combination thereof.

The chamber 2 may have at least one through-hole formed in its wall, a window 21 may be installed in the through-hole, and the pulse laser beam 32 from the laser apparatus 3 may travel through the window 21. An EUV collector mirror 23 having a spheroidal surface may, for example, be provided in the chamber 2. The EUV collector mirror 23 may have a first focus and a second focus.

The EUV collector mirror 23 may have a multi-layered reflective film including alternately laminated molybdenum layers and silicon layers formed on the surface thereof. The EUV collector mirror 23 is preferably positioned such that the first focus lies in a plasma generation region 25 and the second focus lies in an intermediate focus (IF) region 292. The EUV collector mirror 23 may have a through-hole 24 formed at the center thereof and a pulse laser beam 33 may travel through the through-hole 24.

The EUV light generation apparatus 1 may include an EUV light generation controller 5 and a target sensor 4. The target sensor 4 may have an imaging function and detect at least one of the presence, trajectory, position, and speed of a target 27.

Further, the EUV light generation system 11 may include a connection part 29 for allowing the interior of the chamber 2 to be in communication with the interior of the exposure apparatus 6. A wall 291 having an aperture may be provided in the connection part 29. The wall 291 may be positioned such that the second focus of the EUV collector mirror 23 lies in the aperture.

The EUV light generation apparatus 1 may also include a laser beam direction control unit 34, a laser beam focusing mirror 22, and a target collector 28 for collecting targets 27. The laser beam direction control unit 34 may include an optical element for defining the direction and an actuator for adjusting the position, the orientation or posture, and the like of the optical element.

3.2 Operation

With reference to FIG. 1, a pulse laser beam 31 outputted from the laser apparatus 3 may pass through the laser beam direction control unit 34 and, as the pulse laser beam 32, travel through the window 21 and enter the chamber 2. The pulse laser beam 32 may travel inside the chamber 2 along at least one beam path, be reflected by the laser beam focusing mirror 22, and strike at least one target 27 as a pulse laser beam 33.

The target supply device 26 may be configured to output the target(s) 27 toward the plasma generation region 25 in the chamber 2. The target 27 may be irradiated with at least one pulse of the pulse laser beam 33. Upon being irradiated with the pulse laser beam, the target 27 may be turned into plasma, and rays of light 251 may be emitted from the plasma.

The EUV light 252 included in the light 251 may be reflected selectively by the EUV collector mirror 23. EUV light 252 reflected by the EUV collector mirror 23 may be focused at the intermediate focus region 292 and be outputted to the exposure apparatus 6. Here, the target 27 may be irradiated with multiple pulses included in the pulse laser beam 33.

The EUV light generation controller 5 may be configured to integrally control the EUV light generation system 11. The EUV light generation controller 5 may be configured to process image data of the target 27 captured by the target sensor 4. Further, the EUV light generation controller 5 may be configured to control: the timing when the target 27 is outputted and the direction into which the target 27 is outputted, for example.

Furthermore, the EUV light generation controller 5 may be configured to control at least one of: the timing when the laser apparatus 3 oscillates, the direction in which the pulse laser beam 33 travels, and the position at which the pulse laser beam 33 is focused. It will be appreciated that the various controls mentioned above are merely examples, and other controls may be added as necessary.

4. Comparative Example of Target Producing Unit

4.1 Configuration

Figure 2:
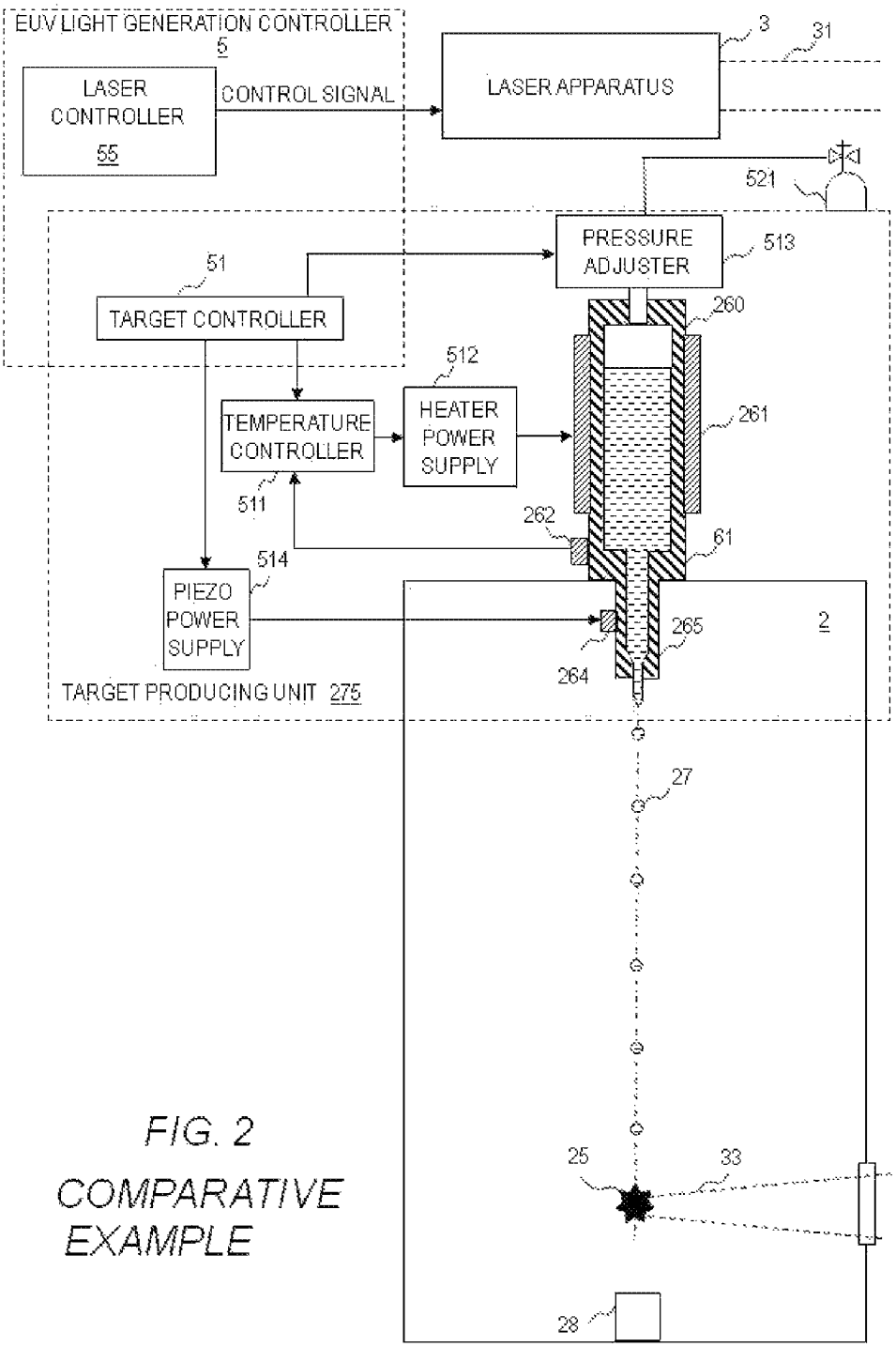
FIG. 2 schematically illustrates a configuration of a part of an EUV light generation system including a target producing unit of a comparative example.

FIG. 2 schematically illustrates a configuration of a part of the EUV light generation system 11 including a target producing unit 275 of a comparative example. The EUV light generation controller 5 may include a target controller 51 and a laser controller 55. The target controller 51 may control the operation of the other components in the target producing unit 275. The laser controller 55 may control the operation of the laser apparatus 3.

The target producing unit 275 may include the target controller 51, a temperature controller 511, a heater power supply 512, a pressure adjuster 513, a piezo power supply 514, and a droplet supply device 260.

The droplet supply device 260 may be mounted on the chamber 2. The droplet supply device 260 may include a tank 61, a heater 261, a temperature sensor 262, and a piezoelectric element 264. The tank 61 may have a nozzle 265 at one end thereof.

A part of the tank 61 may be fit in a through-hole formed in a wall of the chamber 2 and the nozzle 265 formed in the tank 61 may be located inside the chamber 2. The nozzle 265 may have a nozzle hole to eject droplet material therethrough. The heater 261 and the temperature sensor 262 may be anchored on the outside of the tank 61. The piezoelectric element 264 may be anchored on the outside of the nozzle 265.

A target collector 28 may be a cylindrical tank to receive droplets. The target collector 28 may be placed on the extension of the trajectory of the target droplets 27.

4.2 Operation

The droplet supply device 260 may store the target material in the tank 61 in a melted state with the heater 261. The target material may be tin, for example. The target controller 51 may control the temperature of the heater 261 to change the tin in the tank 61 into a liquid state by controlling the heater power supply 512 with the temperature controller 511. As a result, the tin stored in the tank 61 may be melted.

The target controller 51 may control the piezo power supply 514 to send an electric signal to the piezoelectric element 264 at such a frequency to produce droplets from the liquid tin ejected from the nozzle 265.

The target controller 51 may control the pressure adjuster 513 so that target droplets 27 will reach the plasma generation region 25 at a predetermined speed of, for example, 60 m/s to 100 m/s. The pressure adjuster 513 may adjust the pressure in the tank 61 by controlling the pressure of inactive gas supplied from an inactive gas supply device 521 in accordance with an instruction from the target controller 51.

The pressure in the tank 61 may be raised to, for example, 10 MPa to 20 MPa. As a result, the target material may be ejected from the nozzle 265 to supply target droplets 27 to the plasma generation region 25.

The ejected target droplets 27 may have diameters of 20 μm to 30 μm and travel at 60 m/s to 110 m/s. The laser controller 55 may control the laser apparatus 3 to irradiate the plasma generation region 25 with a pulse laser beam 33 in synchronization with arrival of target droplets 27 at the plasma generation region 25. As a result, the target droplets 27 may turn into plasma to generate EUV light.

Target droplets 27 not irradiated with the pulse laser beam 33 may pass through the plasma generation region 25, go along the trajectory of droplets, enter the target collector 28, and be stored in the state of liquid tin.

4.3 Issues

Figure 3A:
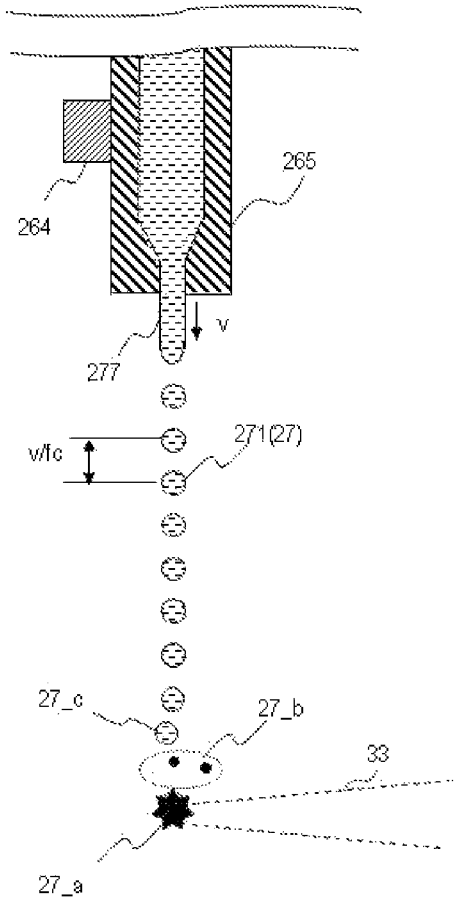
FIG. 3A illustrates an issue in the target producing unit of the comparative example.

FIG. 3A illustrates an issue in the foregoing target producing unit 275 of the comparative example. According to Rayleigh's small perturbation stability theory, when oscillating a jet 277 of the target material having a diameter d and flowing at a speed v at a frequency f, uniformly sized droplets may be formed if the wavelength λ (λ=v/f) of the oscillation generated in the jet 277 satisfies a predetermined condition. The predetermined condition for the wavelength λ may be λ/d=4.51, for example. The uniformly sized droplets may be repeatedly formed at the frequency f.

The frequency at which uniformly sized droplets may be repeatedly formed is defined as a carrier frequency fc. The carrier frequency may be also called Rayleigh frequency. The above-described method of producing droplets may be referred to as continuous jet method.

The interval between droplets 271 (target droplets 27) ejected from the nozzle 265 may be expressed as v/fc. The interval between droplets may become shorter depending on the carrier frequency fc.

If the interval between droplets is too short, generation of plasma of a target droplet 27_*a* may affect and destroy the next target droplet 27_*b*, or otherwise, may change the trajectory of the next target droplet 27_*b* or the following target droplet 27_*c*.

Accordingly, producing droplets having an intended speed, an intended diameter, and intended intervals and providing such droplets to the plasma generation region 25 may be important.

Figure 3B:
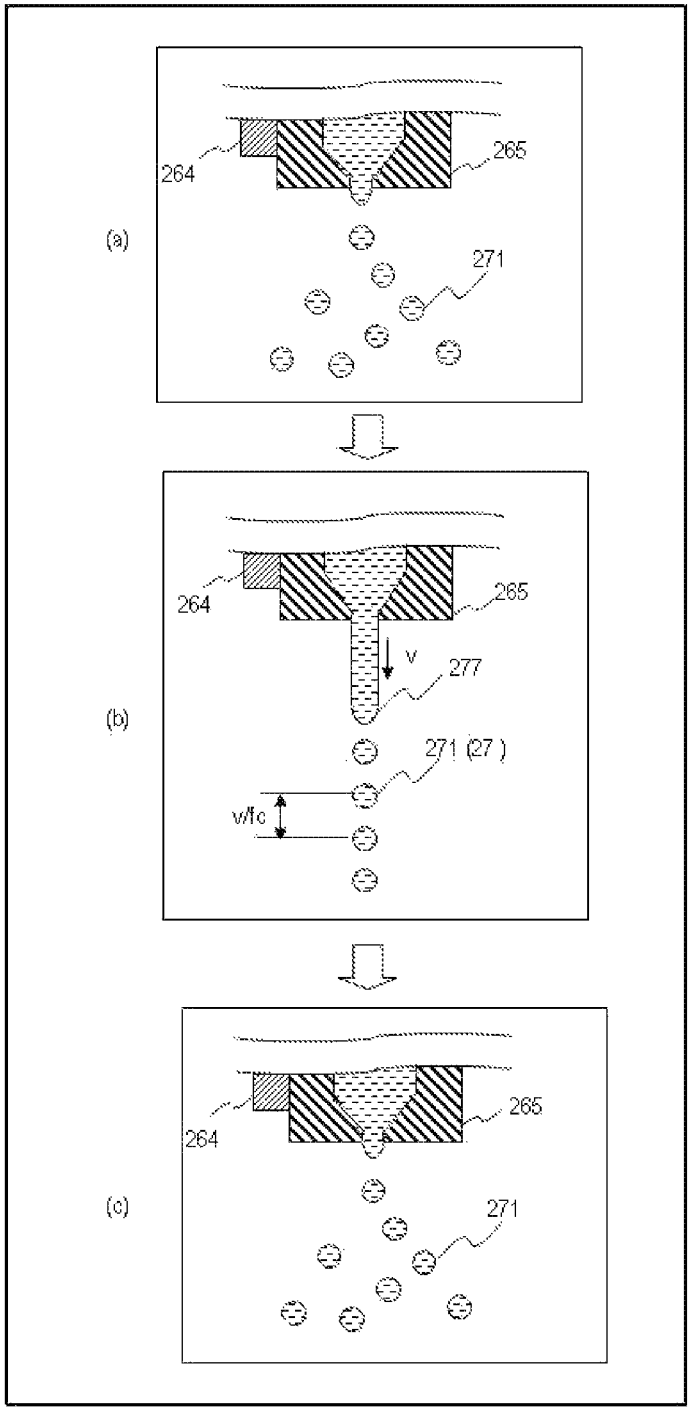
FIG. 3B illustrates another issue in the target producing unit of the comparative example.

FIG. 3B illustrates another issue in the foregoing target producing unit 275 of the comparative example. In FIG. 3B, FIG. 3B(a) schematically illustrates the state of droplets 271 immediately after start of ejection of the droplet material from the nozzle 265. FIG. 3B(b) schematically illustrates the state when the droplet supply device 260 steadily ejects a jet 277 and droplets 271 from the nozzle 265. FIG. 3B(c) schematically illustrates the state of droplets 271 immediately before stop of ejection of the droplet material from the nozzle 265. The operating status of the droplet supply device 260 may change in the order of FIG. 3B(a), FIG. 3B(b), and FIG. 3B(c).

The pressure applied to the droplet material in the tank 61 may be low immediately after the start and immediately before the stop of ejection of the droplet material from the nozzle 265. For example, the applied pressure may vary from 0 MPa to 1 MPa immediately after the start of ejection and may vary from 1 MPa to 0 MPa immediately before the stop of ejection. Accordingly, producing droplets 271 and the trajectories of the droplets 271 may become unstable immediately after the start and immediately before the stop of ejection of the droplet material. As a result, some droplets 271 may not be collected into the target collector 28 but drop onto the surface of the EUV collector mirror.

5. Target Producing Unit Including Charging Electrode

Hereinafter, a configuration example to address the above-described issues is described. The target producing unit described hereinafter may include a charging electrode for charging droplets ejected from the droplet supply device. The charging electrode may control the electric polarity of each droplet ejected from the droplet supply device so that some successive droplets will join together to become a target droplet.

The droplets ejected from the droplet supply device 260 may include groups composed of k successive droplets. Each group may include one or more electrified droplets. The speed change of the electrified droplets because of the Coulomb force may cause k droplets of one group to join together into a target droplet. The target droplet may be created before reaching the plasma generation region.

In each group, at least one droplet at an end may be positively or negatively charged. The droplet at the other end may be uncharged or charged with the same polarity of the droplet adjacent to the droplet at the other end in the same group.

Charging droplets with a charging electrode to join a plurality of droplets into a target droplet as described above may enable appropriate control of the speed, the diameter, and the interval of the target droplets. Controlling the charging of the droplets at the both ends in each group as described above may reduce the effects of the attraction from the adjacent group on producing a target droplet.

5.1 Configuration

Figure 4:
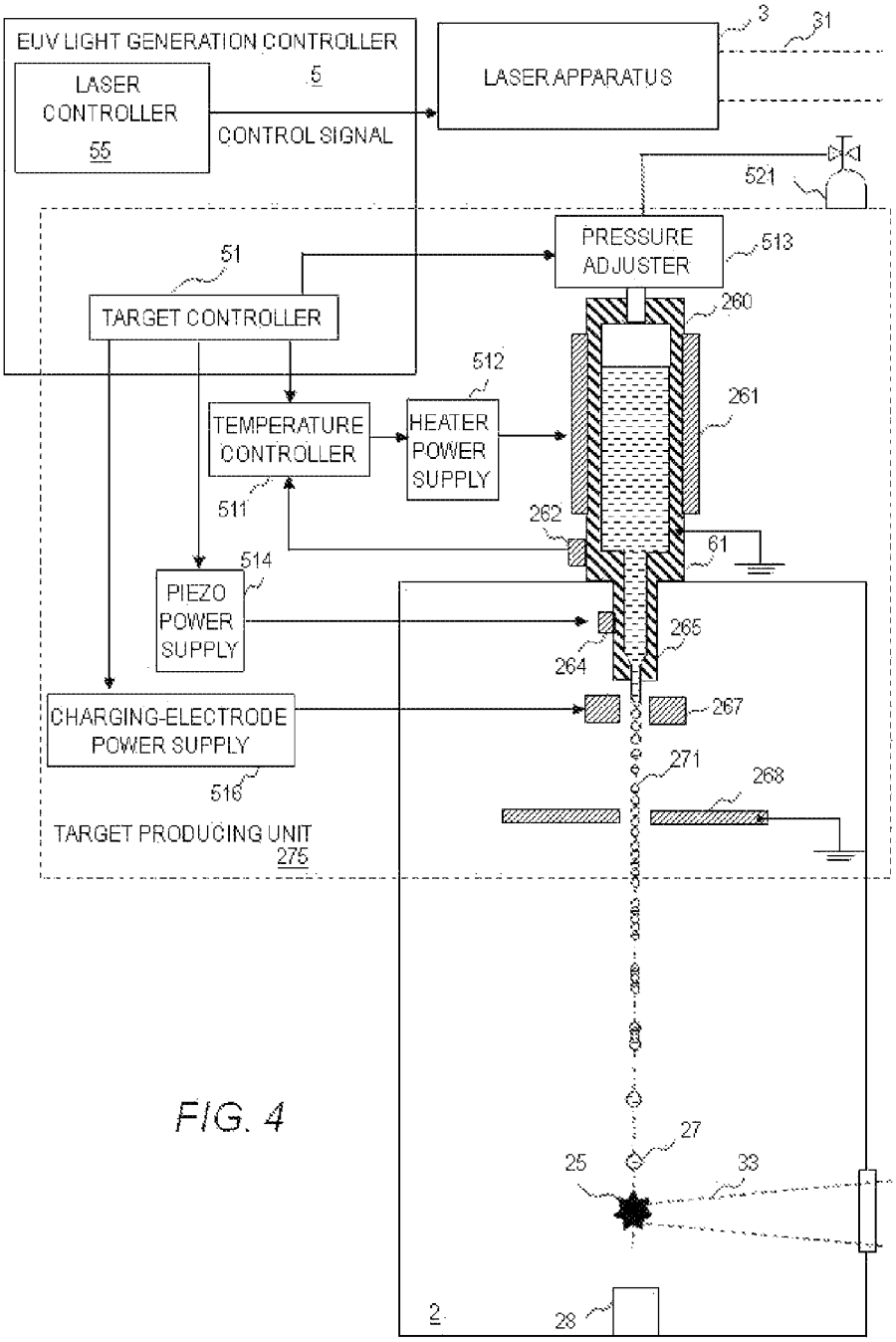
FIG. 4 schematically illustrates a configuration example of a target producing unit in the present embodiment.

FIG. 4 schematically illustrates a configuration example of a target producing unit 275 in the present embodiment. The EUV light generation controller 5 may include a target controller 511 and a laser controller 55. The target controller 51 may control the operation of the other components in the target producing unit 275. The laser controller 55 may control the operation of the laser apparatus 3.

The target producing unit 275 may include a target controller 51, a temperature controller 51, a heater power supply 512, a pressure adjuster 513, a piezo power supply 514, a charging electrode 267, a shielding electrode 268, a charging-electrode power supply 516, and a droplet supply device 260.

The droplet supply device 260 may be mounted on the chamber 2. The droplet supply device 260 may include a tank 61, a heater 261, a temperature sensor 262, and a piezoelectric element 264. The tank 61 may have a nozzle 265 at one end thereof. The tank 61 may be made of molybdenum metal and connected with the ground.

A part of the tank 61 may be fit in a through-hole formed in a wall of the chamber 2 and the nozzle 265 formed in the tank 61 may be located inside the chamber 2. The nozzle 265 may have a nozzle hole to eject droplet material therethrough.

The heater 261 and the temperature sensor 262 may be anchored on the outside of the tank 61. The heater 261 may be connected with the output of the heater power supply 512. The piezoelectric element 264 may be anchored on the outside of the nozzle 265. The piezoelectric element 264 may be connected with the output of the piezo power supply 514.

The pressure adjuster 513 may be provided on the pipe between the inactive gas supply device 521 and the tank 61 to adjust the pressure of the inactive gas supplied from the inactive gas supply device 521 into the tank 61.

The pressure adjuster 513 may include a pressure controller, a valve, and a pressure sensor. The pressure controller may receive a target value for the pressure from the target controller 51 and control the aperture of the valve so that the value detected by the pressure sensor will be substantially the same as the target value.

The target collector 28 may be a cylindrical tank to receive droplets. The target collector 28 may be placed on the extension of the trajectory of the target droplets 27. The target collector 28 may be connected with the output of a not-shown power supply.

The charging electrode 267 may be placed between the nozzle 265 of the droplet supply device 260 and the plasma generation region 25. The charging electrode 267 may be an annular electrode having a through-hole to pass the droplets 271 ejected from the droplet supply device 260 therethrough.

The charging electrode 267 may be placed so that the central axis of the through-hole substantially matches the trajectory of the droplets 271 separated from the jet 277. The charging electrode 267 may also be placed so that the tip of the jet is positioned in the through-hole of the charging electrode 267. Such positioning may enable appropriate control of the charge amount for each droplet 271. The charging electrode 267 may be connected with the output of the charging-electrode power supply 516.

The shielding electrode 268 may be an annular electrode including a through-hole to pass the droplets 271 therethrough. The shielding electrode 268 may be placed between the charging electrode 267 and the plasma generation region 25. The shielding electrode 268 may be placed so that the central axis of the through-hole substantially matches the trajectory of the droplets 271 that have passed through the charging electrode 267. The shielding electrode 268 may be connected with the ground. The shielding electrode 268 may block the electric charge from the plasma generation region 25.

Figure 5:
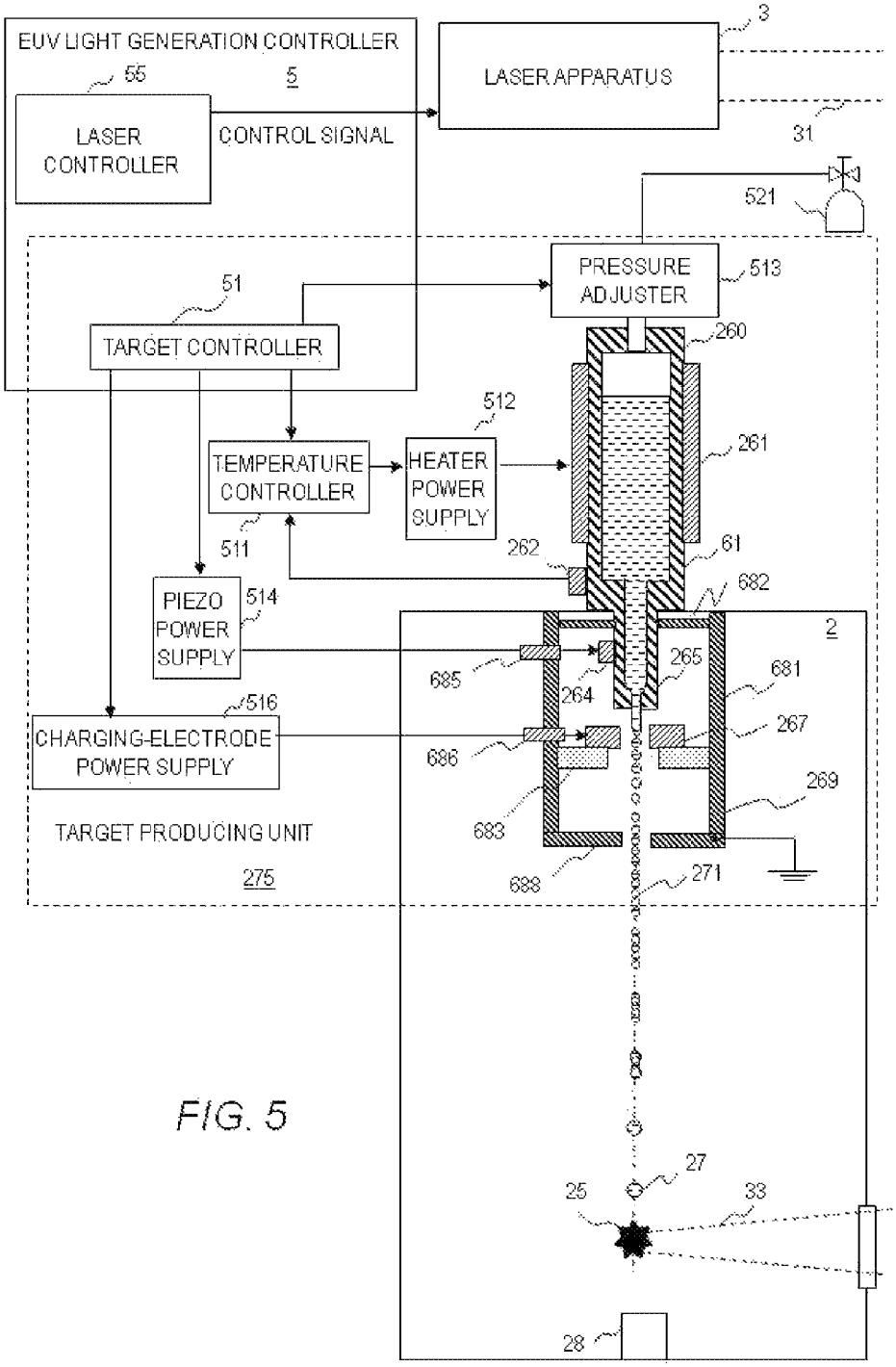
FIG. 5 schematically illustrates another configuration example of a target producing unit in the present embodiment.

FIG. 5 schematically illustrates another configuration example of a target producing unit 275. The target producing unit 275 may include a cylindrical cover 269 having a through-hole that can pass the droplets 271 therethrough, instead of the annular shielding electrode 268. The cover 269 may have a cylindrical side wall 681. The cover 269 may be connected with the ground.

The cover 269 may be fixed on the droplet supply device 260 with a metallic cover fixing member 682. The cover 269 may have a fixing member 683 for supporting and fixing the charging electrode 267 inside of the cover 269.

The cover 269 may have a terminal 685 for connecting the piezo power supply 514 and the piezoelectric element 264 with each other on the side wall 681. The cover 269 may have a terminal 686 for connecting the charging-electrode power supply 516 and the charging electrode 267 with each other on the side wall 681.

The cover 269 may surround the periphery of the nozzle 265. The cover 269 may have a plate 688 having a through-hole that can pass the droplets 271 therethrough between the tip of the nozzle and the plasma generation region 25. The plate 688 may block the electric charge from the plasma generation region 25.

5.2 Operation

Upon receipt of a target producing signal from a function unit of the EUV light generation controller 5, the target controller 51 may control the heater 261 based on the value measured by the temperature sensor 262. The temperature controller 511 may control the electric power to be supplied from the heater power supply 512 to the heater 261 in accordance with an instruction from the target controller 51.

The target controller 51 may control the heater 261 so that the tin in the tank 61 will be heated to a predetermined temperature equal to or higher than the melting point. As a result, the tin stored in the tank 61 may be melted. The melting point of tin is 232° C.; the predetermined temperature may be a temperature between 232° C. and 270° C., for example.

The target controller 51 may control the temperature of the target collector 28 to a predetermined temperature so that the tin collected by the target collector 28 will become liquid. The predetermined temperature may be a temperature between 232° C. and 270° C., for example. A not-shown heater and a not-shown temperature sensor may be anchored to the target collector 28. The target controller 51 may control the heater with a not-shown temperature controller, based on the temperature detected by the temperature sensor.

The target controller 51 may control the pressure inside the tank 61 with the pressure adjuster 513. The pressure adjuster 513 may adjust the pressure inside the tank 61 to a predetermined pressure in accordance with an instruction from the target controller 51 so that the target droplets 27 will reach the plasma generation region 25 at a predetermined speed. The predetermined speed may be, for example, 60 m/s to 100 m/s. The predetermined pressure in the tank 61 may be 10 MPa to 20 MPa. As a result, a jet 277 of the target material may be ejected from the hole of the nozzle 265 at a predetermined speed.

The target controller 51 may send an electric signal at a carrier frequency fc to the piezo power supply 514 to oscillate the piezoelectric element 264 at the carrier frequency fc. The nozzle 265 may oscillate with the oscillation of the piezoelectric element 264 at the carrier frequency fc. The carrier frequency fc may be, for example, 1500 kHz.

The oscillation of the nozzle 265 at the carrier frequency fc may cause the jet 277 to oscillate at the carrier frequency fc. As a result, droplets 271 may be produced from the jet 277 at the carrier frequency fc.

The target controller 51 may control the potential (charging-electrode potential) of the charging electrode 267 in timing of ejection of a droplet 271. The target controller 51 may control the potential of the charging electrode 267 by sending a control signal to the charging-electrode power supply 516. The droplet 271 may be charged positively, charged negatively, or uncharged depending on the potential of the charging electrode 267. The target controller 51 may control the charging the droplets 271 so that a predetermined number of droplets 271 will join into a target droplet 27. The control of the potential of the charging electrode 267 will be described later.

At least a part of the droplets 271 may be charged positively or negatively by the charging electrode 267 and a predetermined number of droplets may join together to become a target droplet 27 because of the Coulomb force on the charged droplets 271.

The laser controller 55 may control the laser apparatus 3 to irradiate the plasma generation region 25 with a pulse laser beam 33 in synchronization with arrival of a target droplet 27 at the plasma generation region 25. The target sensor 4 may detect a target droplet 27 created by joining of a plurality of droplets 271. The target droplet 27 may be changed to plasma with the pulse laser beam 33 to generate EUV light.

The target droplets 27 not irradiated with the pulse laser beam 33 may pass through the plasma generation region 25, further go along the trajectory of target droplets 27, enter the target collector 28, and be stored in the state of liquid tin.

5.3 Effects

The above-described configurations may charge the droplets 271 produced at the carrier frequency fc in a specific pattern, so that the change in speed caused by the Coulomb force makes a predetermined number of droplets 271 join together to create a target droplet 27.

Among the droplets 271 to join together into a target droplet 27, making the number of negatively charged droplets 271 equal to the number of positively charged droplets 271 may create an uncharged target droplet 27. This approach may reduce the Coulomb force between target droplets 27, achieving a stable and straight trajectory of target droplets 27.

The joining of a plurality of droplets 27 may enlarge the interval between target droplets 27, which may prevent plasma generated by a target droplet 27 from destroying the next target droplet 27 or changing the trajectories of the subsequent target droplets 27.

The grounded shielding electrode 268 or cover 269 may shield the charging electrode 267 from the electric charges caused by generation of plasma. The shielding electrode 268 or the cover 269 may reduce the electric charges that reach the charging electrode 267 from the plasma generation region 25, preventing unstable operation of the charging electrode 267.

5.4 Operation Pattern in Steady Operation

Figure 6:
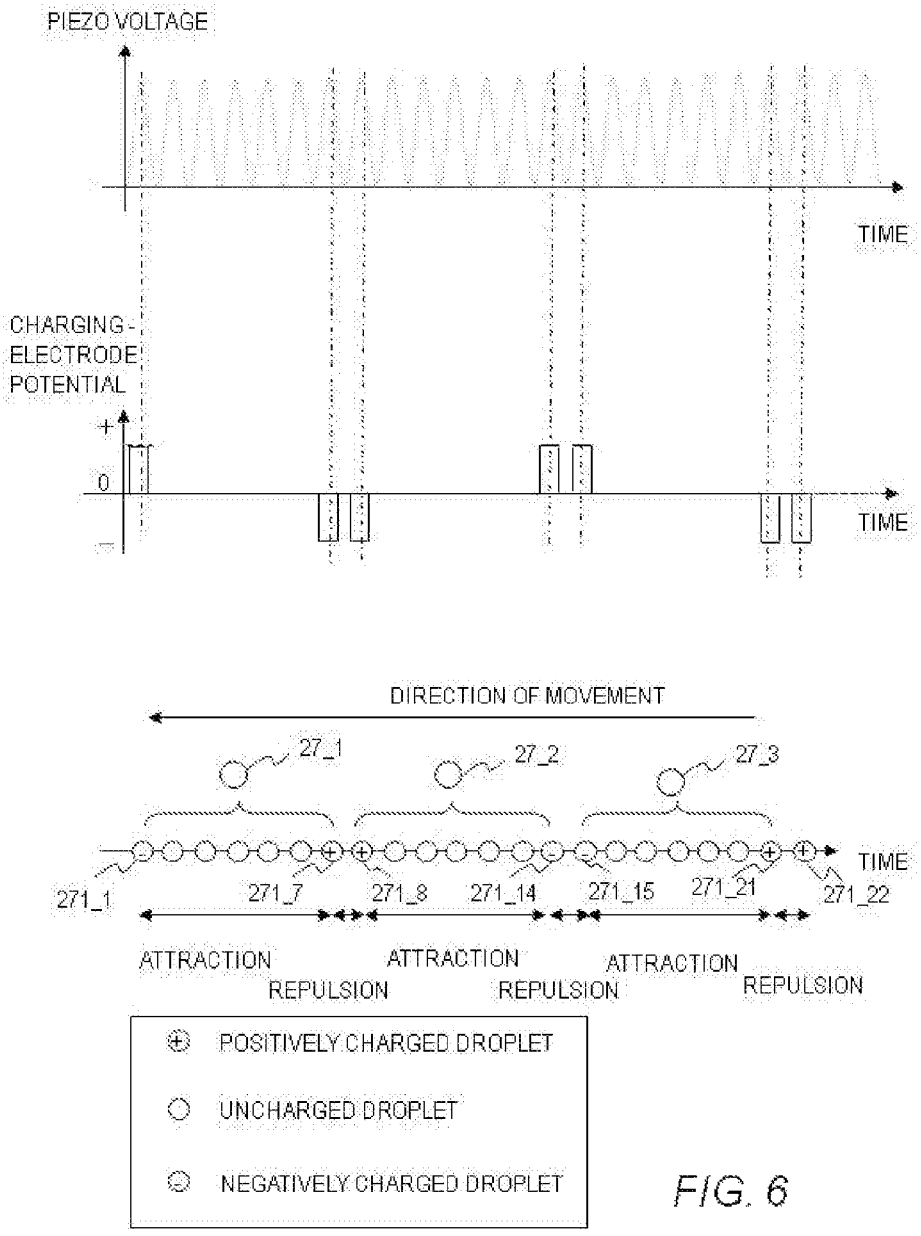
FIG. 6 illustrates an example of a relation among piezo voltage, charging-electrode potential, and charged statuses of droplets before joining when the target producing unit is in steady operation.

FIG. 6 illustrates an example of a relation among the piezo voltage, the charging-electrode potential, and the charged statuses of droplets 271 before joining when the target producing unit 275 is in steady operation. The time axis is common to the piezo voltage, the charging-electrode potential, and the droplets 271. The piezo voltage and the charging-electrode potential are synchronized with each other. The ejected droplets 271 move from right to left in FIG. 6.

When the charging electrode 267 is maintained at a positive potential or a negative potential synchronously with the voltage of the piezoelectric element 264, a droplet 271 may be charged negatively or positively. Since the tank 61 is grounded, the jet 277 may be charged negatively or positively when the droplet 271 is separated from the jet 277. As a result, the droplet 271 may be charged negatively or positively.

The charging-electrode potential changes from 0 V to a predetermined positive or negative potential, is maintained at the predetermined positive or negative voltage, and then returns to 0 V in each pulse period. The positive potential of the charging electrode 267 may be a potential of, for example, +5 V to +250 V; the negative potential of the charging electrode 267 may be a potential of −5 V to −250 V. When the potential of the charging electrode 267 is maintained at 0 V, the droplet 271 may not be charged.

The target controller 51 may control the charging-electrode potential synchronously with the piezo voltage using the above-described principle, so that each droplet 271 may become one status selected from positively charged, negatively charged, and uncharged.

In the example of FIG. 6, the droplet supply device 260 may eject a droplet 271 at each peak of the piezo voltage. To charge a droplet 271 positively or negatively, the target controller 51 may apply a predetermined negative or positive potential to the charging electrode 267 for a predetermined period including the peak time of the piezo voltage for this droplet 271. The period to apply the potential may be determined to avoid the peak times of the piezo voltage for the adjacent droplets 271 so as not to affect the charges of the adjacent droplets 271.

The target controller 51 may charge a droplet 271 negatively by maintaining the charging electrode 267 at a positive potential. The target controller 51 may charge a droplet 271 positively by maintaining the charging electrode 267 at a negative potential. The target producing unit 275 may charge droplets 271 by repeating the identical charging-electrode potential pattern. One charging-electrode potential pattern may charge one or more groups.

In the example of FIG. 6, the first droplet 271_1 may be charged negatively and the seventh droplet 271_7 may be charged positively. The droplets between the droplet 271_1 and the droplet 271_7 may be uncharged.

The eighth droplet 271_8 may be charged positively and the 14th droplet 271_14 may be charged negatively. The droplets between the droplet 271_8 and the droplet 271_14 may be uncharged. The 15th droplet 271_15 may be charged negatively and the 21st droplet 271_21 may be charged positively. The droplets between the droplet 271_15 and the droplet 271_21 may be uncharged. The 22nd droplet 271_22 may be charged positively.

The droplets 271_1 to 271_7 may constitute the first group. The droplets 271_8 to 271_14 may constitute the second group. The droplets 271_15 to 271_21 may constitute the third group. The second group is adjacent to the first group and the third group.

In the first group, the droplet 271_1 and the droplet 271_7 may come close to each other because of the attraction of the Coulomb force. As a result, the droplets 271_1 to 271_7 may join together to become the first target droplet 27_1.

In the second group, the droplet 271_8 and the droplet 271_14 may come close to each other because of the attraction of the Coulomb force. As a result, the droplets 271_8 to 271_14 may join together to become the second target droplet 27_2.

In the third group, the droplet 271_15 and the droplet 271_21 may come close to each other because of the attraction of the Coulomb force. As a result, the droplets 271_15 to 271_21 may join together to become the third target droplet 27_3.

The number of droplets to join together may be controlled easily by arranging the number of uncharged droplets within a group. Minimizing the number of droplets 271 to be charged positively or negatively may facilitate charging control for the droplets 271.

Between two groups adjacent to each other, the polarities of two adjacent droplets 271 in the different groups may be the same. As a result, Coulomb repulsion may work to appropriately create target droplets 27 group by group. The Coulomb repulsion may prevent reduction in interval between target droplets 27.

For example, in the example of FIG. 6, the last droplet 271_7 in the first group may be charged positively and the first droplet 271_8 in the second group may also be charged positively. The last droplet 271_14 in the second group may be charged negatively and the first droplet 271_15 in the third group may also be charged negatively. The last droplet 271_21 in the third group may be charged positively and the next droplet 271_22 may also be charged positively.

In the example of FIG. 6, each group may be uncharged as a whole. That is to say, each group includes an equal number of positively charged droplets 271 and negatively charged droplets 271 and the total amount of charge may be zero. Accordingly, joining of droplets 271 in the group may neutralize the charge in the group. The target droplet 27 of the joined droplets may be uncharged to reduce the variation in trajectory caused by the Coulomb force between target droplets 27.

Figure 7:
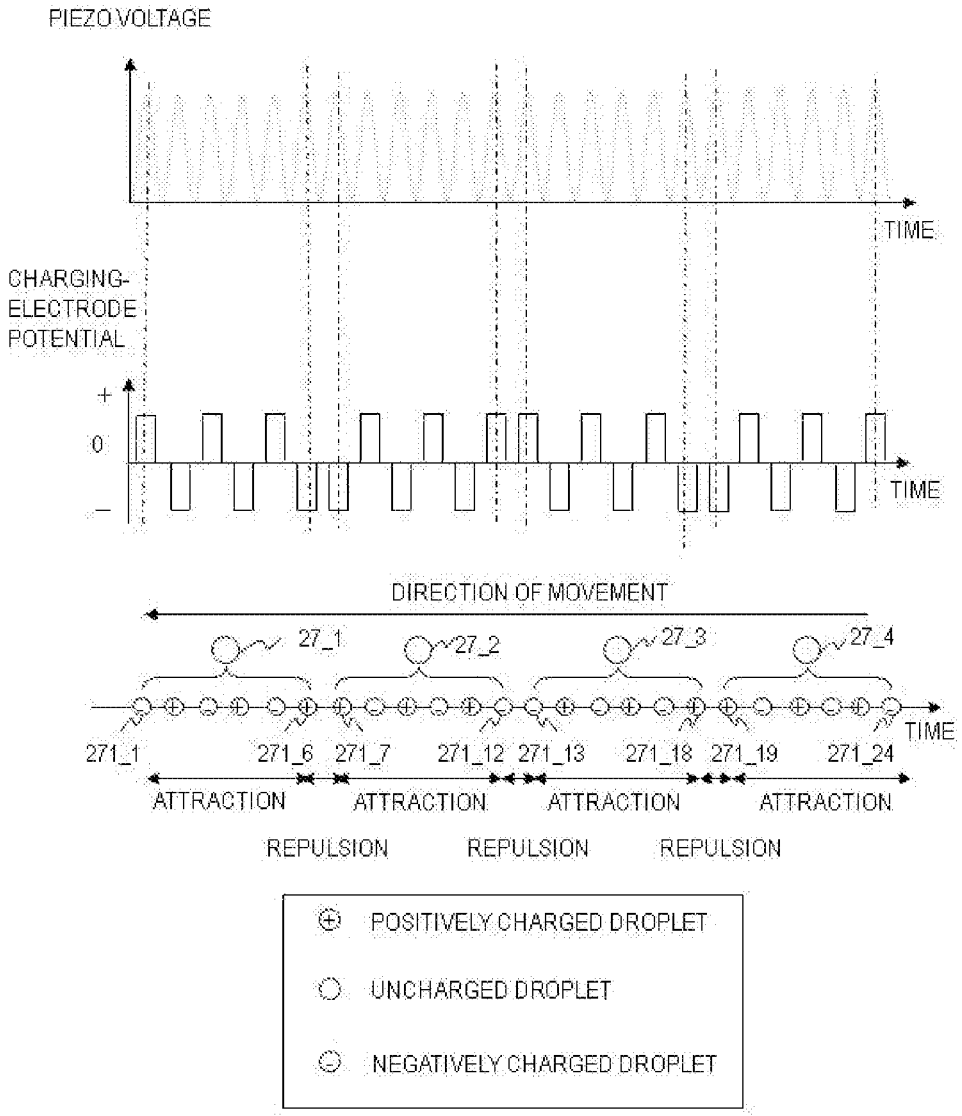
FIG. 7 illustrates another example of a relation among piezo voltage, charging-electrode potential, and charged statuses of droplets before joining when the target producing unit is in steady operation.

FIG. 7 illustrates another example of a relation among the piezo voltage, the charging-electrode potential, and the charged statuses of droplets 271 before joining when the target producing unit 275 is in steady operation. In the following, differences from the configuration in FIG. 6 are mainly described. As to the charging-electrode potential in FIG. 7, the adjacent two pulses of the same polarity may be one pulse.

In the example of FIG. 7, the first droplet 271_1 to the sixth droplet 271_6 may constitute the first group and join together to become the first target droplet 27_1. The seventh droplet 271_7 to the 12th droplet 271_12 may constitute the second group and join together to become the second target droplet 27_2.

The 13th droplet 271_13 to the 18th droplet 271_18 may constitute the third group and join together to become the third target droplet 27_3. The 19th droplet 271_19 to the 24th droplet 271_24 may constitute the fourth group and join together to become the fourth target droplet 27_4.

In each group, all the droplets 271 may be charged positively or negatively. In each group, the polarities of adjacent two droplets 271 may be opposite to each other. All the droplets 271 in each group may speedily and unfailingly join together because of the Coulomb force. In the example of FIG. 7, each group may include at least one uncharged droplet.

Each group may include an equal number of positively charged droplets 271 and negatively charged droplets 271 and the total amount of charge may be zero. Accordingly, the target droplet 27 may be uncharged to reduce the variation in trajectory caused by the Coulomb force between target droplets 27.

Between two groups adjacent to each other, the polarities of two adjacent droplets 271 in the different groups may be the same. As a result, Coulomb repulsion may work to appropriately create target droplets 27 group by group. The Coulomb repulsion may prevent reduction in interval between target droplets 27.

For example, in the example of FIG. 7, the last droplet 271_6 in the first group may be charged positively and the first droplet 271_7 in the second group may also be charged positively. The last droplet 271_12 in the second group may be charged negatively and the first droplet 271_13 in the third group may also be charged negatively. The last droplet 271_18 in the third group may be charged positively and the first droplet 271_19 in the fourth group may also be charged positively.

5.5 Operation Patterns in Ejection Starting Period and Ejection Stopping Period As described with reference to FIG. 3B, the directions of ejection, namely the trajectories, of droplets 271 may be unstable immediately after start of ejection and immediately before stop of ejection of the droplet material. The target controller 51 in this example may control the charging electrode 267 to charge the droplets 271 in each of the periods including immediately after start of ejection and immediately before stop of the ejection of the droplet material to achieve a straight trajectory of the droplets 271.

Figure 8A:
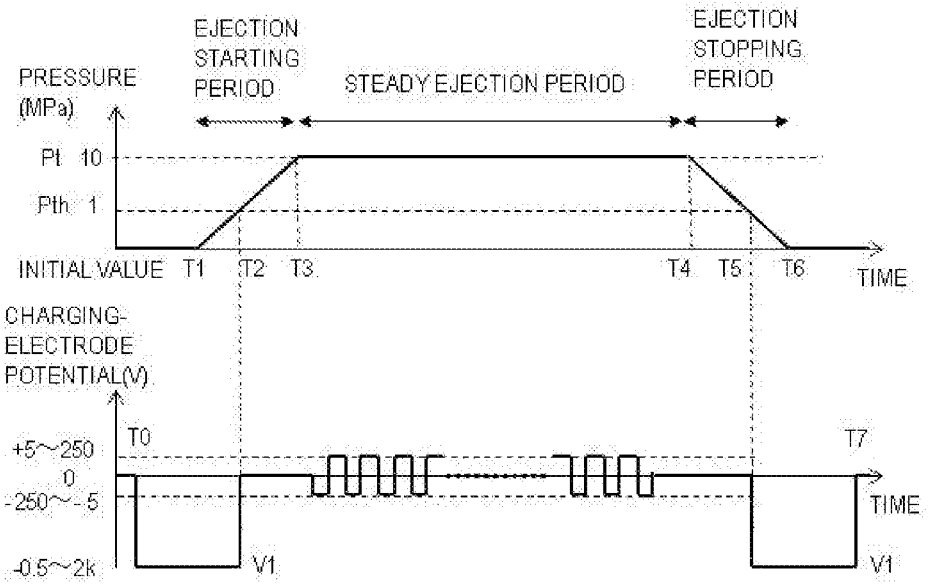
FIG. 8A illustrates a pattern of the pressure applied to the liquid target material in a tank and a pattern of the charging-electrode potential in an ejection starting period, a steady ejection period, and an ejection stopping period for ejection of the target material ejected from a nozzle.

FIG. 8A illustrates a pattern of the pressure applied to the liquid target material of, for example, liquid tin, in the tank 61 and a pattern of charging-electrode potential in the ejection starting period, steady ejection period, and ejection stopping period for ejection of the target material from the nozzle 265.

The pressure adjuster 513 may control the pressure in the tank 61 in accordance with an instruction from the target controller 51. As shown in FIG. 8A, the pressure adjuster 513 may start applying pressure into the tank 61 at a time T1, assuming the pressure in the tank 61 until the time T1 to be the initial value. The pressure in the tank 61 may reach Pth at a time T2, and reach the steady pressure Pt at a time T3. The period between the time T1 and the time T3 may be the ejection starting period.

When the pressure in the tank 61 is Pth or higher, droplets 271 may be ejected in an intended direction. To create target droplets 27, the pressure in the tank 61 may be controlled to be maintained at Pt.

The period from the time T3 to a time T4 may be the steady ejection period. In the steady ejection period, the pressure adjuster 513 may maintain the pressure in the tank 61 at the steady pressure Pt.

The pressure adjuster 513 may start decreasing the pressure in the tank 61 at the time T4. The pressure in the tank 61 may reach Pth at a time T5, and return to the initial value at a time T6. The period from the time T4 to the time T6 may be the ejection stopping period.

The target controller 51 may control the potential of the charging electrode 267 synchronously with the control of pressure in the tank 61. The target controller 51 may change the potential of the charging electrode 267 to a predetermined potential V1 at a time T0 earlier than the time T1 and maintain the potential of the charging electrode 267 at the predetermined potential V1 until the time T2. The target controller 51 may return the potential of the charging electrode 267 to 0 V at the time T2 when the pressure in the tank 61 reaches Pth. The predetermined potential V1 may be either positive or negative.

In the steady ejection period being the period from the time T3 to the time T4, the target controller 51 may control the potential of the charging electrode 267 as described above to join droplets 271.

In the ejection stopping period, the target controller 51 may change the potential of the charging electrode 267 to the predetermined potential V1 at the time T5 when the pressure in the tank 61 reaches Pth. The target controller 51 may maintain the potential of the charging electrode 267 at the predetermined potential V1 until a time T7 which is a time after the end of the ejection stopping period. The target controller 51 may return the potential of the charging electrode 267 to 0 V at the time T7. The charging-electrode potential in the ejection starting period and the ejection stopping period may be the same or different.

Figure 8B:
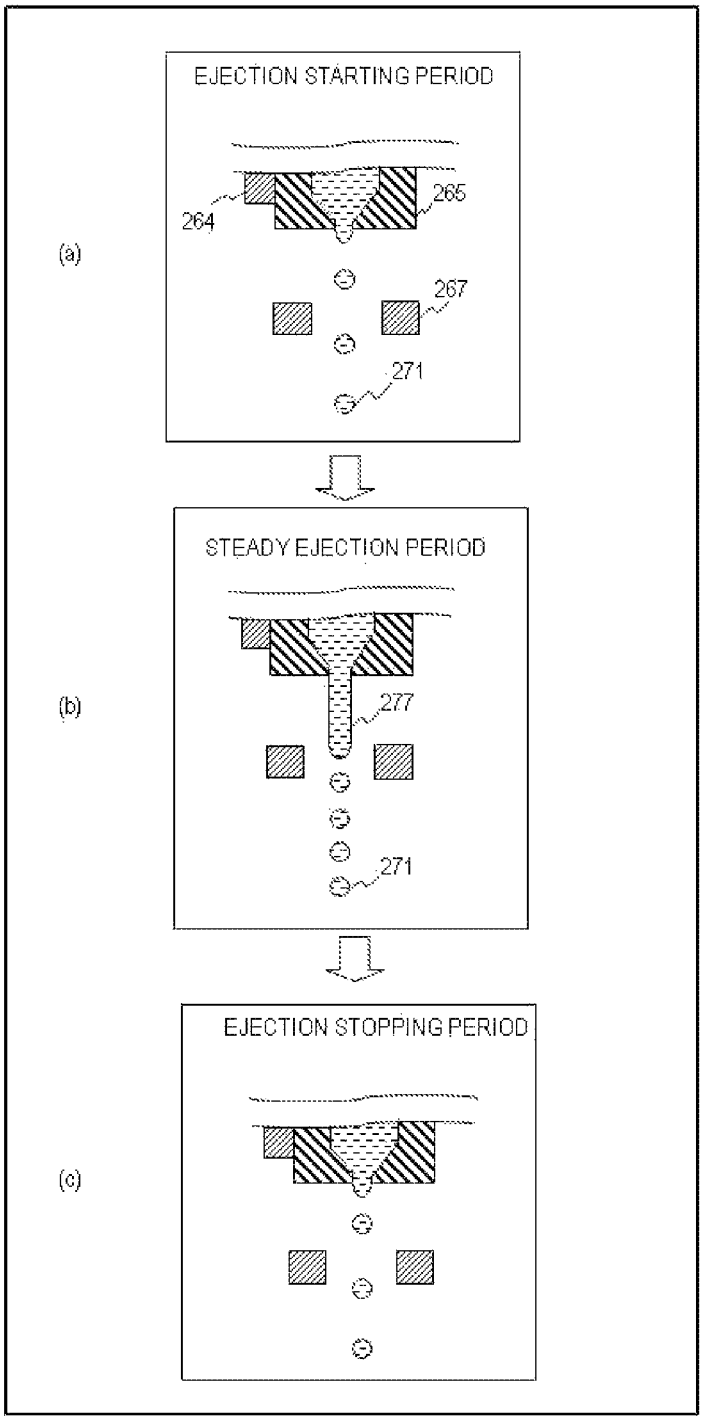
FIG. 8B schematically illustrates states of ejection of droplets in an ejection starting period, a steady ejection period, and an ejection stopping period.

FIG. 8B schematically illustrates states of ejection of droplets 271 in the ejection starting period, the steady ejection period, and the ejection stopping period. FIG. 8B(a) schematically illustrates a state of ejection of droplets 271 in the ejection starting period. FIG. 8B(b) schematically illustrates a state of ejection of droplets 271 in the steady ejection period. FIG. 8B(c) schematically illustrates a state of ejection of droplets 271 in the ejection stopping period.

In any of these periods, the directions of ejection of droplets 271 are stabilized; the droplets 271 may pass through the through-hole in the charging electrode 267.

Each droplet 271 may be charged at the polarity opposite to the potential of the charging electrode 267. As a result, the droplet 271 may be affected by the Coulomb attraction of the charging electrode 267 to pass through substantially the center of the through-hole in the charging electrode 267. As noted from this case, the Coulomb force from the charging electrode 267 may stabilize the trajectories of droplets 271. The absolute values of the charging-electrode potential in the ejection starting period and the ejection stopping period may be greater than the absolute value of the potential to join droplets 271. As a result, the stability of the trajectories of the droplets 271 may be increased.

Figure 9:
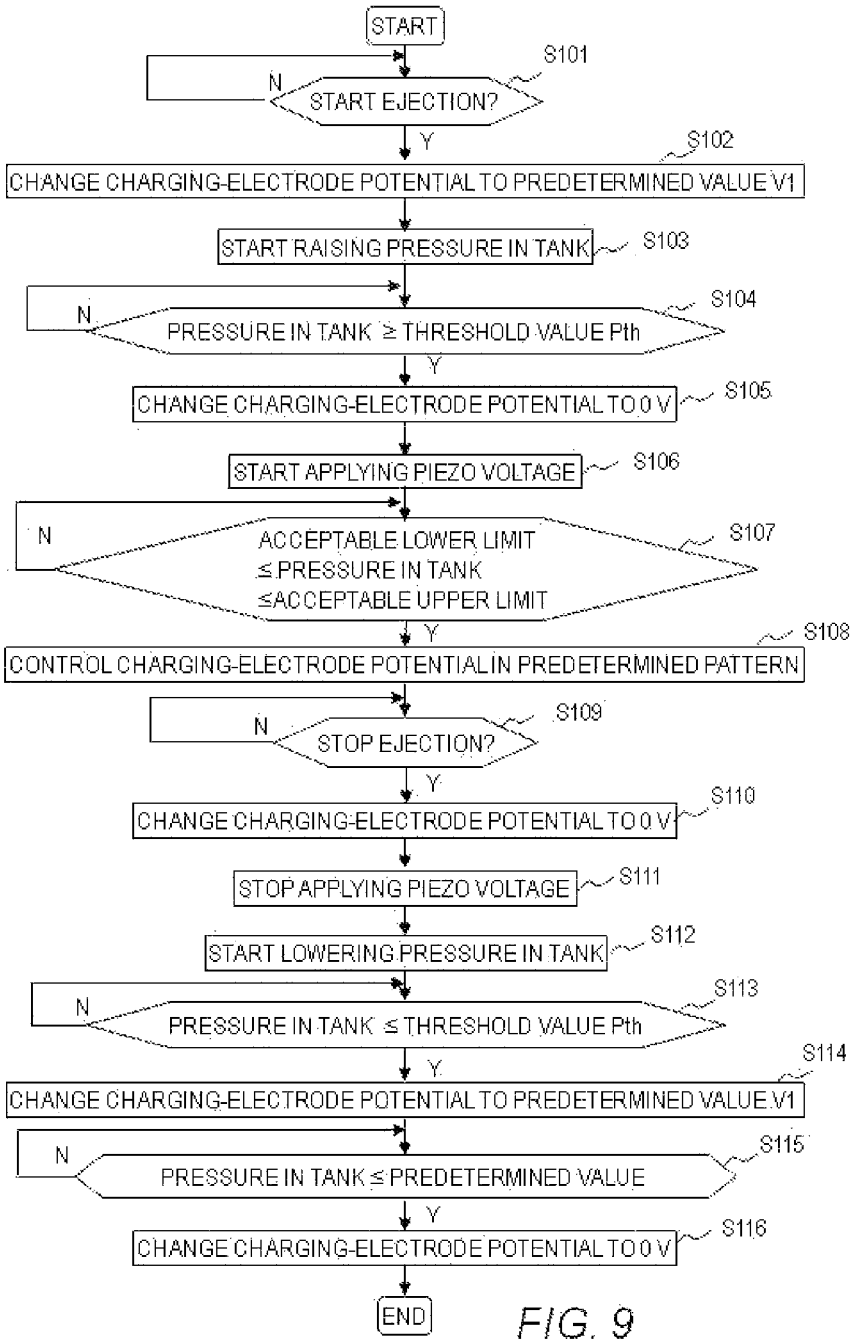
FIG. 9 is an example of a flowchart of a control method for a target controller to control the pressure in the tank and the potential of the charging electrode.

FIG. 9 is an example of a flowchart of a control method for the target controller 51 to control the pressure in the tank 61 and the potential of the charging electrode. The target controller 51 may wait for a signal to start ejection (S101: N). Upon receipt of a signal to start ejection from a function unit of the EUV light generation controller 5 (S101: Y), the target controller 51 may change the potential of the charging electrode 267 to a predetermined potential V1 with the charging-electrode power supply 516 (S102). The predetermined potential V1 may be a value of −0.5 kV to −2 kV.

Next, the target controller 51 may start applying pressure into the tank 61 by controlling the pressure adjuster 513 so that the pressure applied to the liquid tin in the tank 61 will be a target pressure Pt (S103). The target pressure may be, for example, 10 MPa.

The target controller 51 may measure the pressure in the tank 61 by receiving a measured value from a pressure sensor in the pressure adjuster 513 (S104). Because of a high potential gradient between the liquid tin in the nozzle hole and the charging electrode 267 until the measured pressure reaches a threshold value Pth, the liquid tin may be attracted by the Coulomb force to achieve stable trajectories of the charged droplets.

If the measured value of the pressure in the tank 61 reaches the threshold value Pth (S104: Y), the target controller 51 may control the charging-electrode power supply 516 so that the potential of the charging electrode 267 will be 0 V (S105). Thereafter, the target controller 51 may control the piezo power supply 514 to provide a voltage signal having a carrier frequency to the piezoelectric element 264 (S106). As a result, droplets 271 may be produced at the carrier frequency.

When the measured value of the pressure in the tank 61 reaches an acceptable pressure range including a target value Pt, the target controller 51 may control the pressure adjuster 513 so that the measured value of the pressure in the tank 61 will be maintained within the acceptable pressure range (S107). The acceptable lower limit for the acceptable pressure range may be, for example, 9.99 MPa and the acceptable upper limit may be, for example, 10.01 MPa.

The target controller 51 may control the charging-electrode potential in a predetermined pattern while maintaining the pressure in the tank 61 within the acceptable pressure range (S108). Droplets 271 may be produced at the carrier frequency and further, the droplets 271 may be charged in accordance with the pattern of the charging-electrode potential. A predetermined number of successive droplets 271 may join together to become a target droplet 27.

The target controller 51 may wait for a signal to stop the ejection (S109: N). Upon receipt of a signal to stop the ejection from a function unit in the EUV light generation controller 5 (S109: Y), the target controller 51 may change the potential of the charging electrode 267 to 0 V (S110) and stop supplying the voltage signal for the piezoelectric element 264 (S111). Subsequently, the target controller 51 may start decreasing the pressure in the tank 61 (S112). The target controller 51 may set a target pressure (for example, 0 MPa) to the pressure adjuster 513; the pressure adjuster 513 may start adjusting the pressure in the tank 61 so that the measured value of the pressure will be the specified pressure.

The target controller 51 may measure the pressure in the tank 61 by receiving data measured by the pressure adjuster 513 (S113). If the measured value of the pressure in the tank 61 reaches the threshold value Pth (S113: Y), the target controller 51 may control the charging-electrode power supply 516 to change the potential of the charging electrode 267 to the predetermined value V1 (S114).

The target controller 51 may measure the pressure in the tank 61 (S115) and if the measured value reaches a predetermined value (S115: Y), the target controller 51 may change the potential of the charging electrode to 0 V. This predetermined value may be a pressure at which the target material does not come out from the nozzle 265, for example, a pressure equal to the pressure in the chamber 2.

Maintaining the potential of the charging electrode 267 at the predetermined value V1 during a predetermined period in the ejection starting period and a predetermined period in the ejection stopping period may stabilize the directions of ejection of droplets 271. As a result, the droplets 271 may be prevented from dropping onto the surface of the EUV collector mirror. If another configuration for collecting droplets 271 is provided, the target controller 51 may maintain the potential of the charging electrode 267 at the predetermined value V1 in either one of the ejection starting period and the ejection stopping period.

5.6 Target Producing Unit Including Accelerating Electrode

Figure 10:
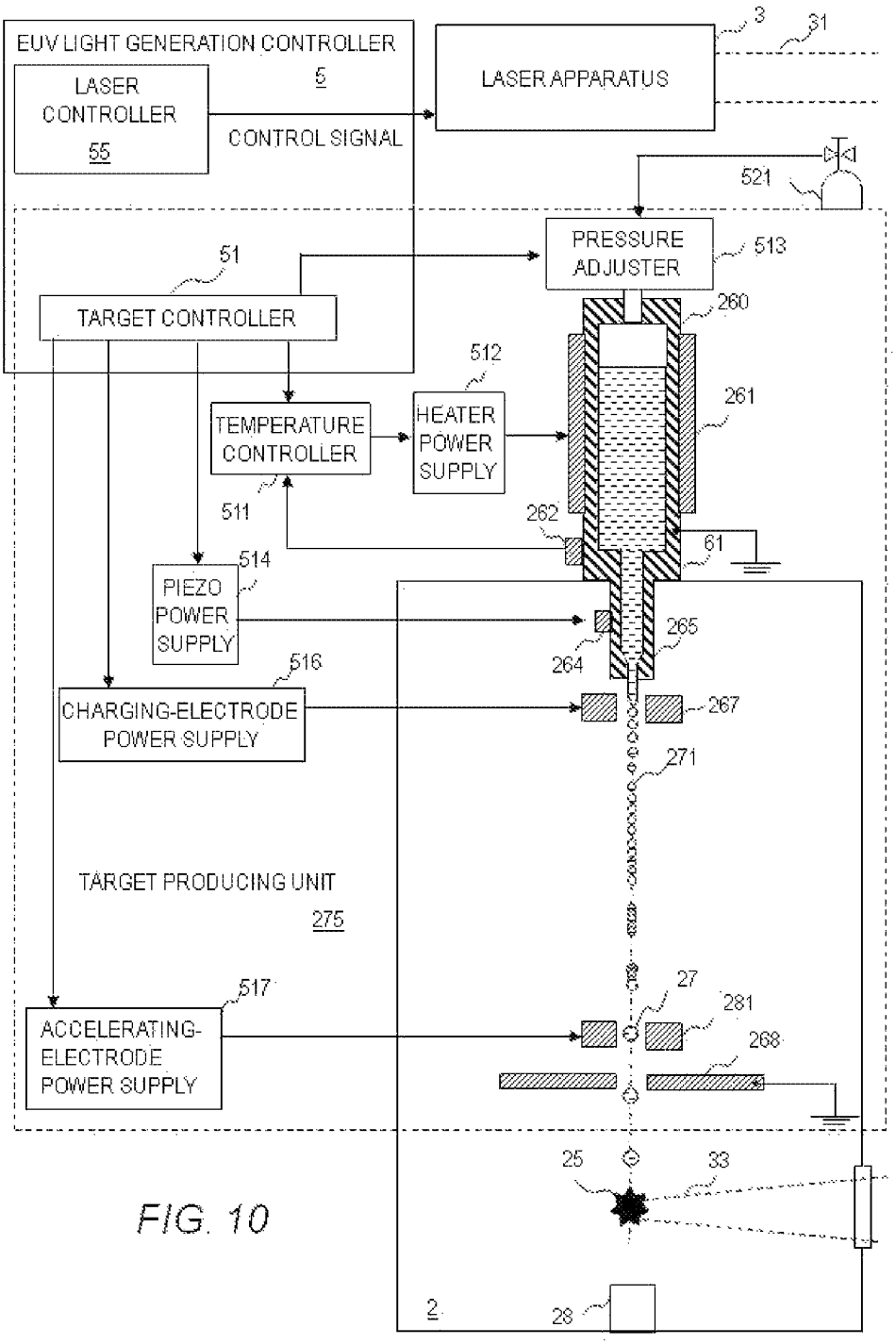
FIG. 10 illustrates a configuration example of a target producing unit including an accelerating electrode.

Hereinafter, an example of a target producing unit 275 including an accelerating electrode is described. FIG. 10 illustrates a configuration example of a target producing unit 275 including an accelerating electrode. In the following, differences from FIGS. 4, 6, and 7 are mainly described. The target producing unit 275 may include an annular accelerating electrode 281 disposed between a charging electrode 267 and a shielding electrode 268. The accelerating electrode 281 may have a through-hole to pass droplets 271 or target droplets 27 therethrough. The center of the through-hole may be on the trajectory of the droplets 271 or the target droplets 27.

The accelerating electrode 281 may be connected with an accelerating-electrode power supply 517. The target controller 51 may control the accelerating-electrode power supply 517 to control the potential of the accelerating electrode 281. The target controller 51 may control the potential of the accelerating electrode 281 synchronously with the carrier frequency of the piezo voltage.

Figure 11:
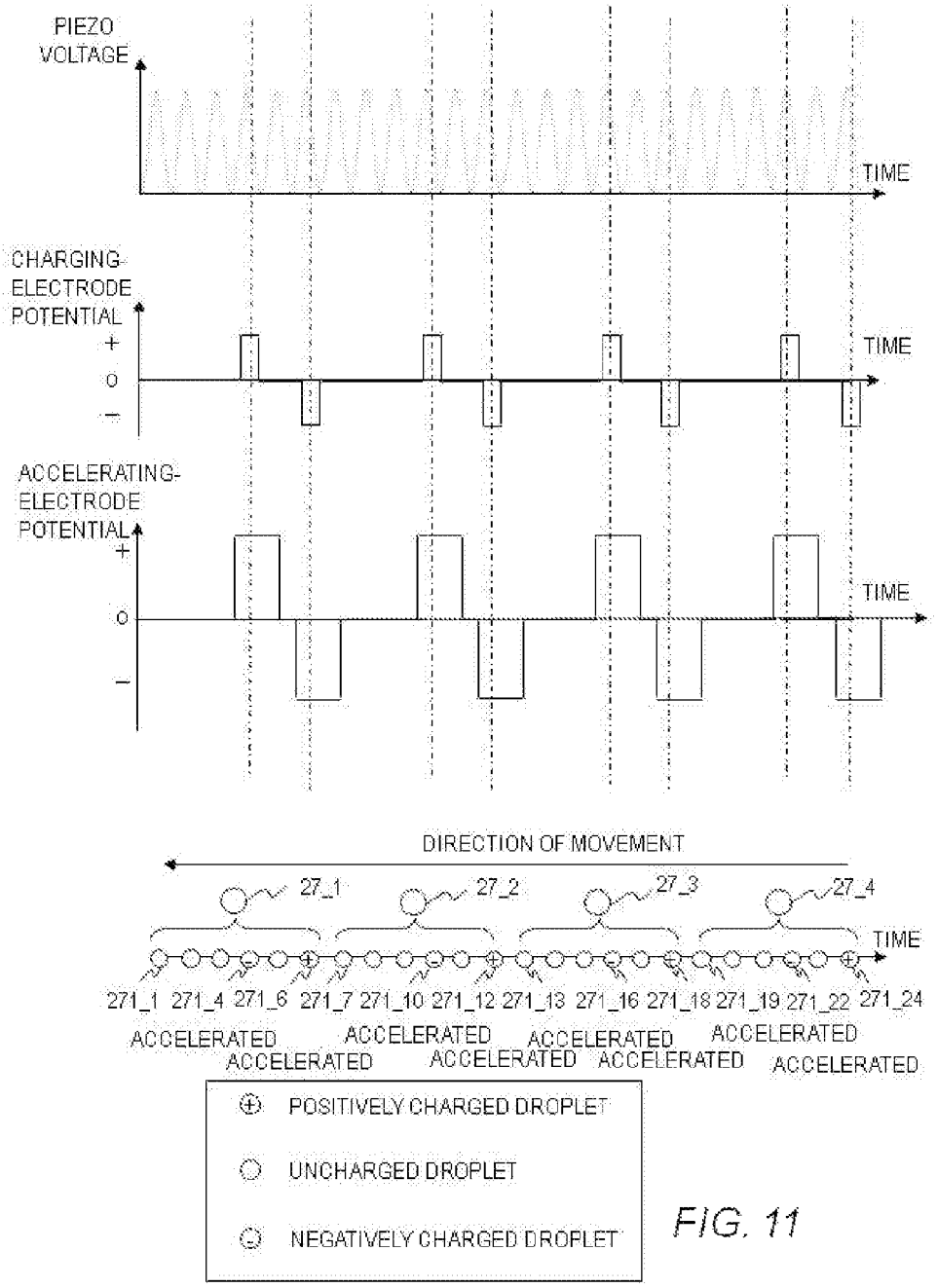
FIG. 11 illustrates an example of a relation among piezo voltage, charging-electrode potential, accelerating-electrode potential, and charged statuses of droplets before joining when the target producing unit is in steady operation.

FIG. 11 illustrates an example of a relation among the piezo voltage, the charging-electrode potential, the accelerating-electrode potential, and the charged statuses of droplets 271 before joining when the target producing unit 275 is in steady operation. The piezo voltage, the charging-electrode potential, and the accelerating-electrode potential are synchronized with one another. Ejected droplets 271 move right to left in FIG. 11.

The charging-electrode potential changes from 0 V to a predetermined positive or negative potential, is maintained at the predetermined positive or negative potential, and then returns to 0 V in each pulse period. The accelerating-electrode potential changes from 0 V to a predetermined positive or negative potential, is maintained at the predetermined positive or negative potential, and then returns to 0 V in each pulse period. The absolute values of the predetermined positive potential and the predetermined negative potential for the accelerating-electrode potential may be different.

The target controller 51 may control the accelerating-electrode potential so that the charged droplets 271 will be accelerated by the Coulomb attraction. As illustrated in FIG. 11, the pulse period of the charging-electrode potential and the corresponding pulse period of the accelerating-electrode potential may include the same peak time of the piezo voltage. The pulse period of the accelerating-electrode potential may include the time at the end of the corresponding pulse of the charging-electrode potential.

The potentials of the corresponding charging-electrode potential pulse and accelerating-electrode potential pulse may be in the same polarity. As a result, a droplet positively or negatively charged by the charging-electrode potential may be attracted and accelerated by the Coulomb force toward the accelerating electrode 281 having a negative or positive potential.

The absolute value of the potential to be applied to the accelerating electrode 281 to accelerate a charged droplet 271 may be greater than the absolute value of the potential to be applied to the charging electrode 267 to charge the droplet 271. As a result, the charged droplet 271 may be accelerated more appropriately.

The target controller 51 may charge the droplet 271 negatively by maintaining the charging electrode 267 at a positive potential. The target controller 51 may charge the droplet 271 positively by maintaining the charging electrode 267 at a negative potential.

In the example of FIG. 11, the fourth droplet 271_4, the 10th droplet 271_10, the 16th droplet 271_16, and the 22nd droplet 271_22 may be charged negatively and the sixth droplet 271_6, the 12th droplet 271_12, the 18th droplet 271_18, and the 24th droplet 271_24 may be charged positively. The other droplets 271 may be uncharged.

The droplets 271_1 to 271_6 may constitute the first group. The droplets 271_7 to 271_12 may constitute the second group. The droplets 271_13 to 271_18 may constitute the third group. The droplets 271_19 to 271_24 may constitute the fourth group.

The target controller 51 may accelerate a negatively charged droplet 271 with the Coulomb attraction by maintaining the accelerating electrode 281 at a positive potential. The target controller 51 may accelerate a positively charged droplet 271 with the Coulomb attraction by maintaining the accelerating electrode 281 at a negative potential.

In the first group, the droplets 271_4 and 271_6 may be accelerated by the attraction of the Coulomb force from the accelerating electrode 281 and the other droplets 271 may not be accelerated. The droplets 271_4 and 271_6 are attracted to each other by the Coulomb force. As a result, six droplets from the droplet 271_1 to the droplet 271_6 may join together to become the first target droplet 27_1.

In the second group, the droplets 271_10 and 271_12 may be accelerated by the attraction of the Coulomb force from the accelerating electrode 281 and the other droplets 271 may not be accelerated. The droplets 271_10 and 271_12 are attracted to each other by the Coulomb force. As a result, six droplets from the droplet 271_7 to the droplet 271_12 join together to become the second target droplet 27_2.

In the third group, the droplets 271_16 and 271_18 may be accelerated by the attraction of the Coulomb force from the accelerating electrode 281 and the other droplets 271 may not be accelerated. The droplets 271_16 and 271_18 are attracted to each other by the Coulomb force. As a result, six droplets from the droplet 271_13 to the droplet 271_18 join together to become the third target droplet 27_3.

In the fourth group, the droplets 271_22 and 271_24 may be accelerated by the attraction of the Coulomb force from the accelerating electrode 281 and the other droplets 271 may not be accelerated. The droplets 271_22 and 271_24 are attracted to each other by the Coulomb force. As a result, six droplets from the droplet 271_19 to the droplet 271_24 join together to become the fourth target droplet 27_4.

Each group may be uncharged as a whole. That is to say, the number of positively charged droplets 271 may be equal to the number of negatively charged droplets 271 in the group and the total amount of charge may be zero. Accordingly, joining of droplets 271 in the group may neutralize the charge in the group. The target droplet 27 of the joined droplets may be uncharged to reduce the variation in trajectory caused by the Coulomb force between target droplets 27.

In a pair of droplets adjacent to each other but belonging to different groups, one droplet may be charged and the other droplet may be uncharged. Since one droplet 271 is uncharged, joining of droplets 271 in different groups and reduction in interval between target droplets 27 caused by the Coulomb attraction between two adjacent groups may be prevented.

The number of uncharged droplets and the number of charged droplets in each group may depend on the design. The number of positively charged droplets does not need to be equal to the number of negatively charged droplets in each group. The positions of the charged droplets and the number of uncharged droplets 271 sandwiched by the charged droplets 271 may depend on the design. As to the charged droplets 271 in each group, droplets 271 adjacent to each other may have the opposite polarities.

The accelerating electrode 281 may be a kind of speed-controlling electrode for controlling the speeds of the droplets 271. The target producing unit 275 may decelerate droplets 271 with a speed-controlling electrode. For example, the first droplet 271 in each group may be charged positively and the fourth droplet 271 may be charged negatively. The target controller 51 may maintain the speed-controlling electrode at a positive potential to decelerate the first droplet 271. The target controller 51 may maintain the speed-controlling electrode at a negative potential to decelerate the fourth droplet 271.

Deceleration of the charged droplets 271 to become slower than the uncharged droplets 271 may cause the droplets 271 of the group to join together into a target droplet 27.

The accelerating electrode 281 may be omitted. As described with reference to FIGS. 8A and 8B, the charging electrode 267 may charge a droplet 271 ejected from the nozzle 265 positively or negatively and further, accelerate the charged droplet 271 with the Coulomb attraction. Since the speeds of the uncharged droplets 271 and the charged droplets 271 are different, a plurality of droplets 271 may join together. The target controller 51 may control the potential of the charging electrode 267 to charge a droplet 271 and further, not to decelerate the charged droplet 271 that has passed through the charging electrode 273.

5.7 Target Producing Unit Including Neutralizer

Figure 12:
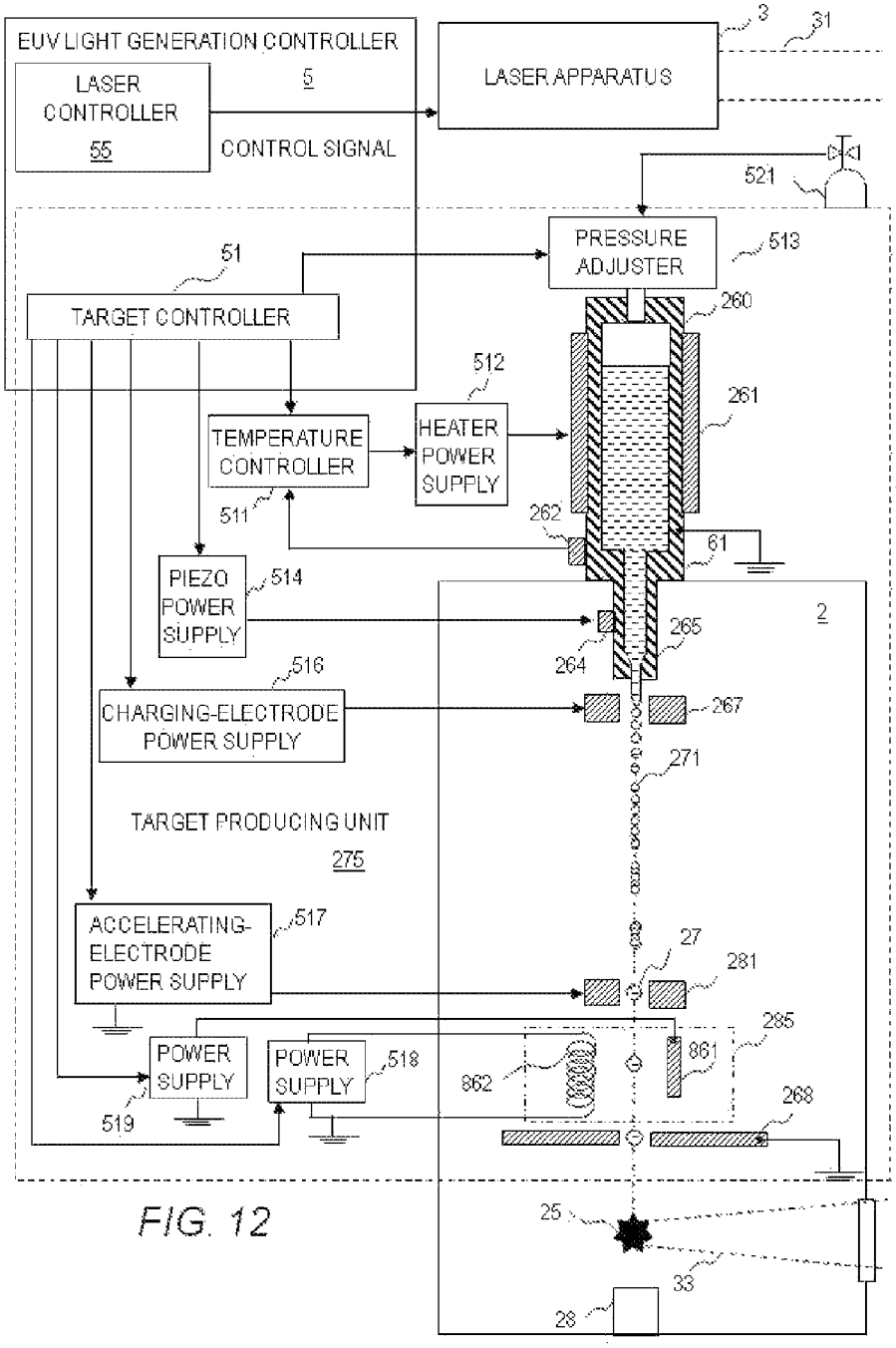
FIG. 12 illustrates a configuration example of a target producing unit including a neutralizer.

Hereinafter, an example of a target producing unit including a neutralizer is described. FIG. 12 illustrates a configuration example of a target producing unit 275 including a neutralizer. In the following, differences from FIGS. 10 and 11 are mainly described. The target producing unit 275 may include a neutralizer 285 disposed between the accelerating electrode 281 and the shielding electrode 268. The target producing unit 275 may include power supplies 518 and 519 for driving the neutralizer 285.

The neutralizer 285 may include a filament 862 and a capturing electrode 861 for capturing electrons. The filament 862 may be made of, for example, tungsten metal. The filament 862 may be connected with the power supply 518. The capturing electrode 861 may be connected with the power supply 519. Target droplets 27 may pass through between the capturing electrode 861 and the filament 862.

The target controller 51 may operate the power supply 518. Feeding a current from the power supply 518 to the filament 862 may cause the filament 862 to generate thermal electrons. The target controller 51 may maintain the potential of the capturing electrode 861 at a positive potential with the power supply 519. As a result, the thermal electrons may be fed to the space where the droplets 271 pass through.

Figure 13:
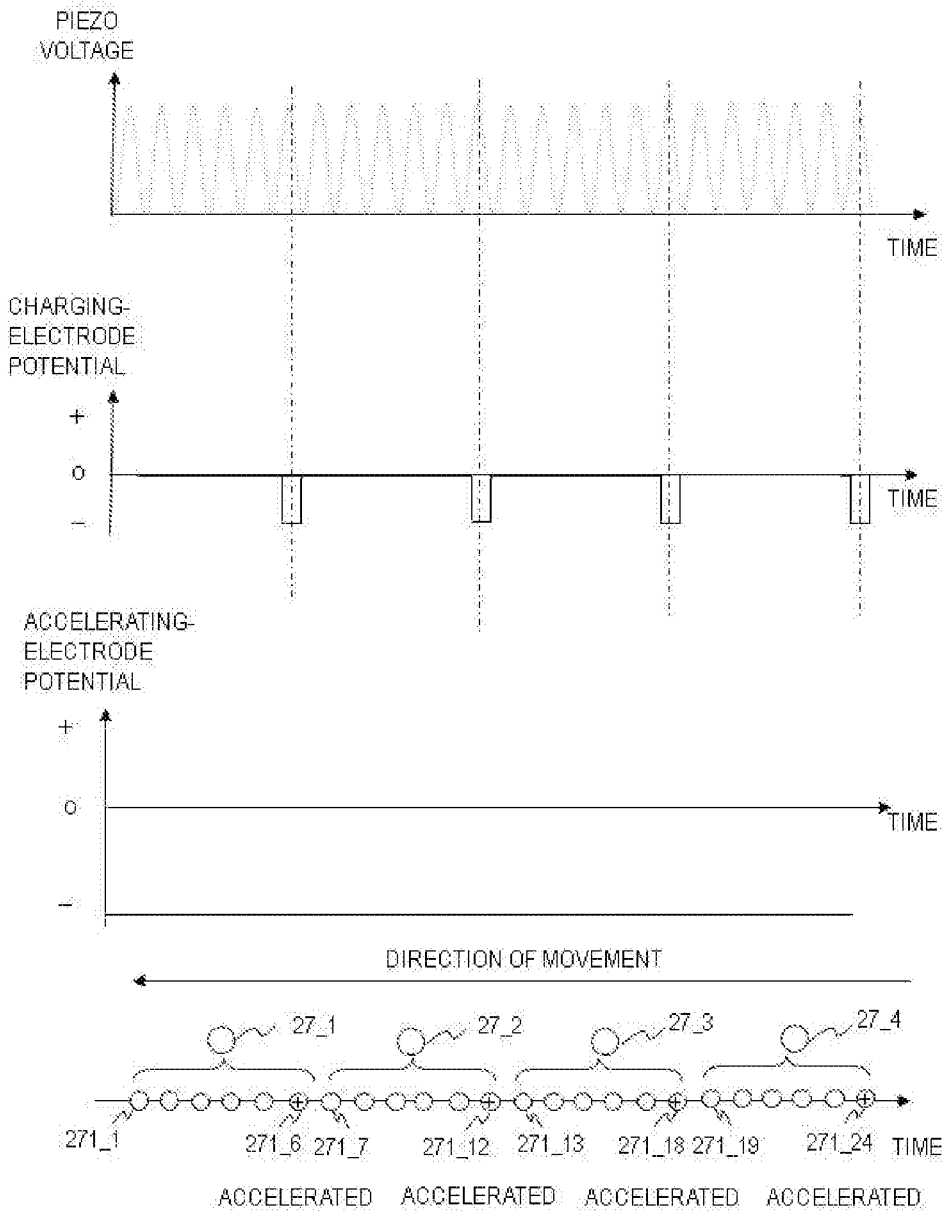
FIG. 13 illustrates an example of a relation among piezo voltage, charging-electrode potential, accelerating-electrode potential, and charged statuses of droplets before joining when the target producing unit is in steady operation.

FIG. 13 illustrates an example of a relation among the piezo voltage, the charging-electrode potential, the accelerating-electrode potential, and the charged statuses of droplets 271 before joining together when the target producing unit 275 is in steady operation. The piezo voltage and the charging-electrode potential may be synchronized with each other. As to the charging-electrode potential, the potential of each pulse may be negative. The accelerating-electrode potential may be maintained at a constant value.

In the example of FIG. 13, the sixth droplet 271_6, the 12th droplet 271_12, the 18th droplet 271_18, and the 24th droplet 271_24 may be charged positively. The other droplets 271 may be uncharged.

The droplets 271_1 to 271_6 may constitute the first group. The droplets 271_7 to 271_12 may constitute the second group. The droplets 271_13 to 271_18 may constitute the third group. The droplets 271_19 to 271_24 may constitute the fourth group.

In the individual groups, the last droplets 271_6, 271_12, 271_18, and 271_24 may be accelerated. The first to the fourth groups of droplets 271 may become target droplets 271_1 to 27_4. Each produced target droplet 27 may be charged positively. The positively charged droplet 27 may pass through the neutralizer 285. The charge of the positively charged target droplet 27 may be neutralized by the thermal electrons generated in the neutralizer 285.

The configuration of neutralizing the charge of the target droplet 27 with the neutralizer 285 may extend the range of selection for the number of positively or negatively charged droplets in a group to become a target droplet 27. Reducing the number of charged droplets in each group may facilitate the charging control for the droplets 271, achieving more precise charging control.

The target producing unit 275 may use a neutralizer for neutralizing negatively charged target droplets 27. The accelerating electrode 281 may be omitted from the target producing unit 275. As described above, the charged droplets 271 may be accelerated by the Coulomb attraction from the charging electrode 267.

6. Target Producing Unit Including Collecting Electrode for Collecting Charged Droplets The target producing unit 275 described hereinafter uses the Coulomb force in the ejection starting period and the ejection stopping period to collect charged droplets 271 to a droplet collecting tank disposed distant from the trajectory. As a result, the droplets 271 may be prevented from attaching onto the surface of the EUV collector mirror.

6.1 Configuration Example 1

Figure 14:
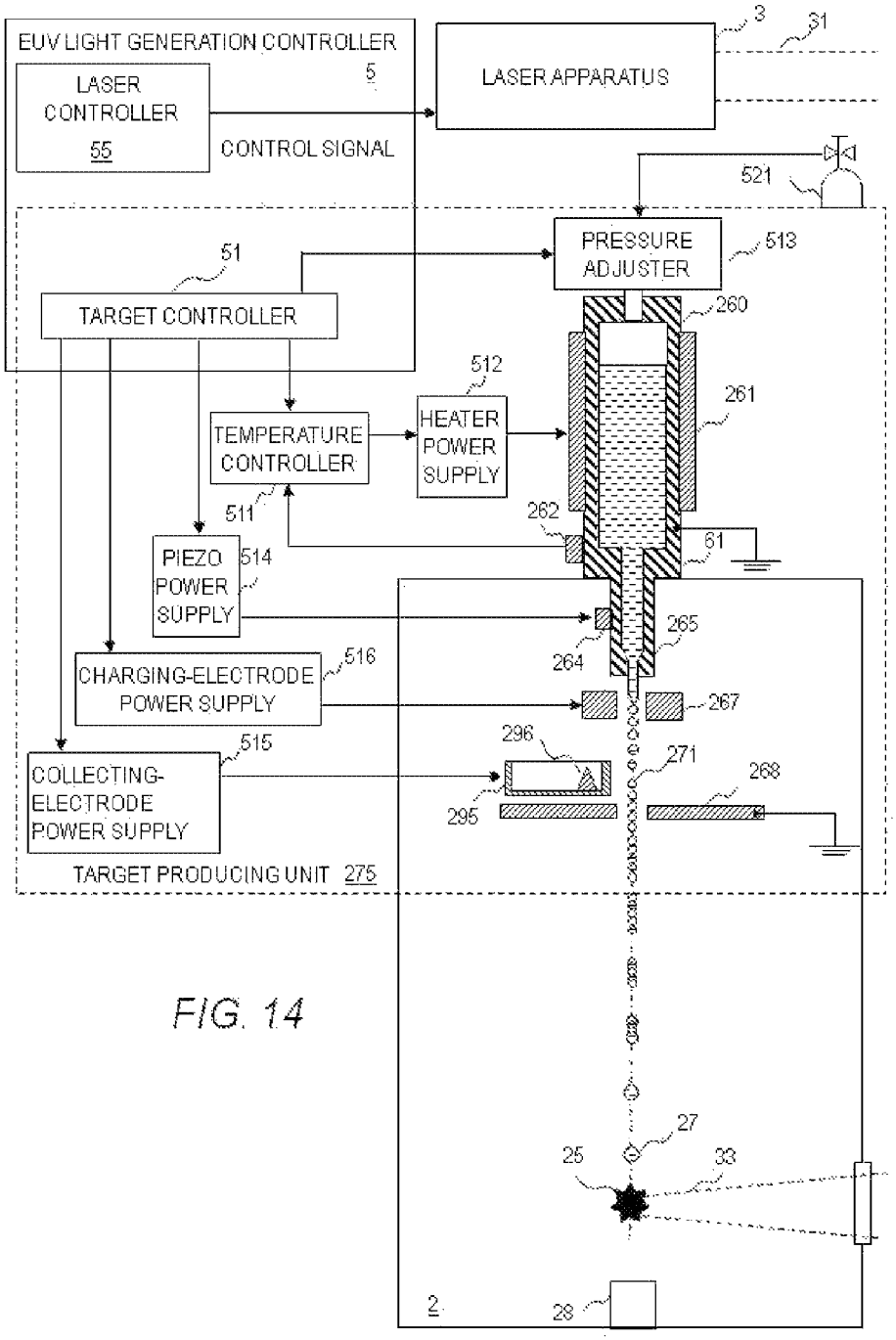
FIG. 14 illustrates a configuration example of a target producing unit including a droplet collecting electrode.

FIG. 14 illustrates a configuration example of a target producing unit 275 including a droplet collecting electrode. In the following, differences from FIG. 4 are mainly described. The target producing unit 275 may include a collecting tank 295, a collecting electrode 296, and a collecting-electrode power supply 515.

The collecting tank 295 may be disposed in the space between the charging electrode 267 and the shielding electrode 268 and at a position distant from the trajectory of droplets 271 in the steady ejection period. The collecting electrode 296 may be disposed in the collecting tank 295. The collecting electrode 296 may be connected with a collecting-electrode power supply 515. The collecting tank 295 and the collecting electrode 296 may be heated to the temperature that may melt the target material.

Figure 15A:
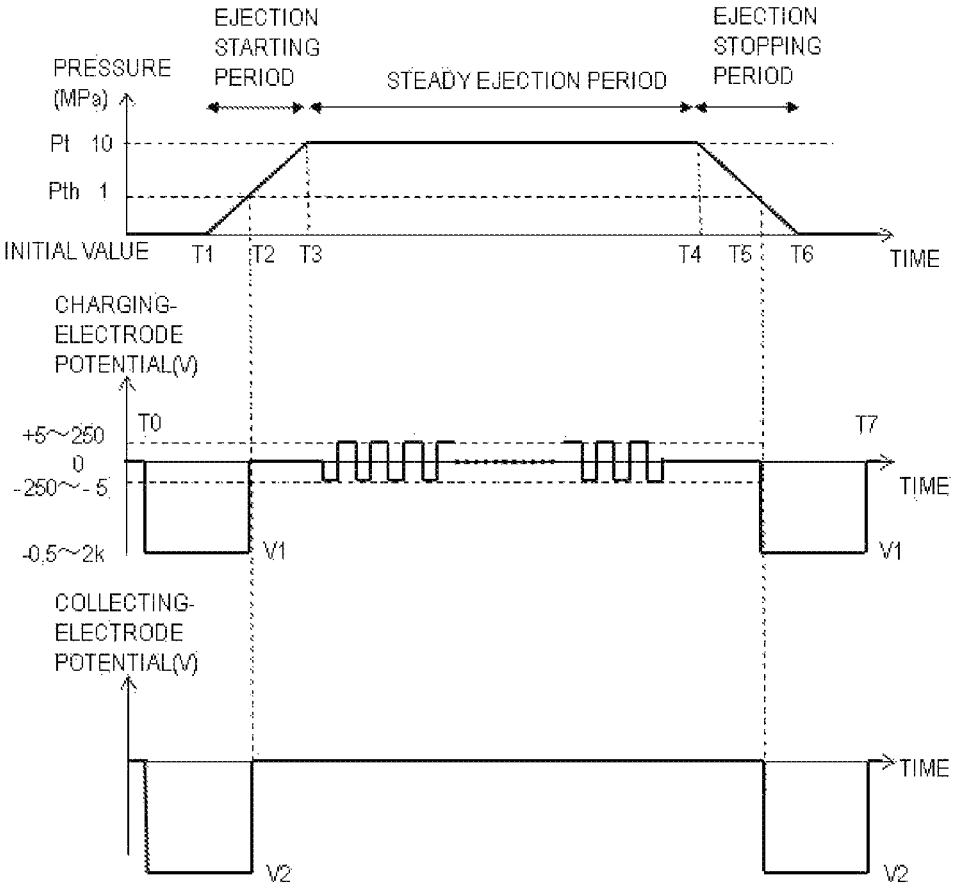
FIG. 15A illustrates patterns of the pressure applied to the liquid target material in a tank, the charging-electrode potential, and the collector-electrode potential in an ejection starting period, a steady ejection period, and an ejection stopping period for the target material ejected from a nozzle.

FIG. 15A illustrates a pattern of the pressure applied to the liquid target material in the tank 61, a pattern of the potential of the charging electrode 267, and a pattern of the potential of the collecting electrode 296 in the ejection starting period, the steady ejection period, and the ejection stopping period of the target material ejected from the nozzle 265. Hereinafter, differences from FIG. 8A are mainly described.

The target controller 51 may control the collecting-electrode power supply 515 to control the potential (collecting-electrode potential) of the collecting electrode 296. The collecting-electrode potential may be synchronized with the charging-electrode potential. For example, the target controller 51 may change the charging-electrode potential and the collecting-electrode potential at the same time.

The target controller 51 may apply a potential of V2 as a potential to collect droplets 271 to the collecting electrode 296. The polarity of the potential V2 for the collecting electrode 296 may be the same as the polarity of the potential V1 for the charging electrode 267. The absolute value of the potential V2 for the collecting electrode 296 may be greater than the absolute value of the potential V1 for the charging electrode 267.

Figure 15B:
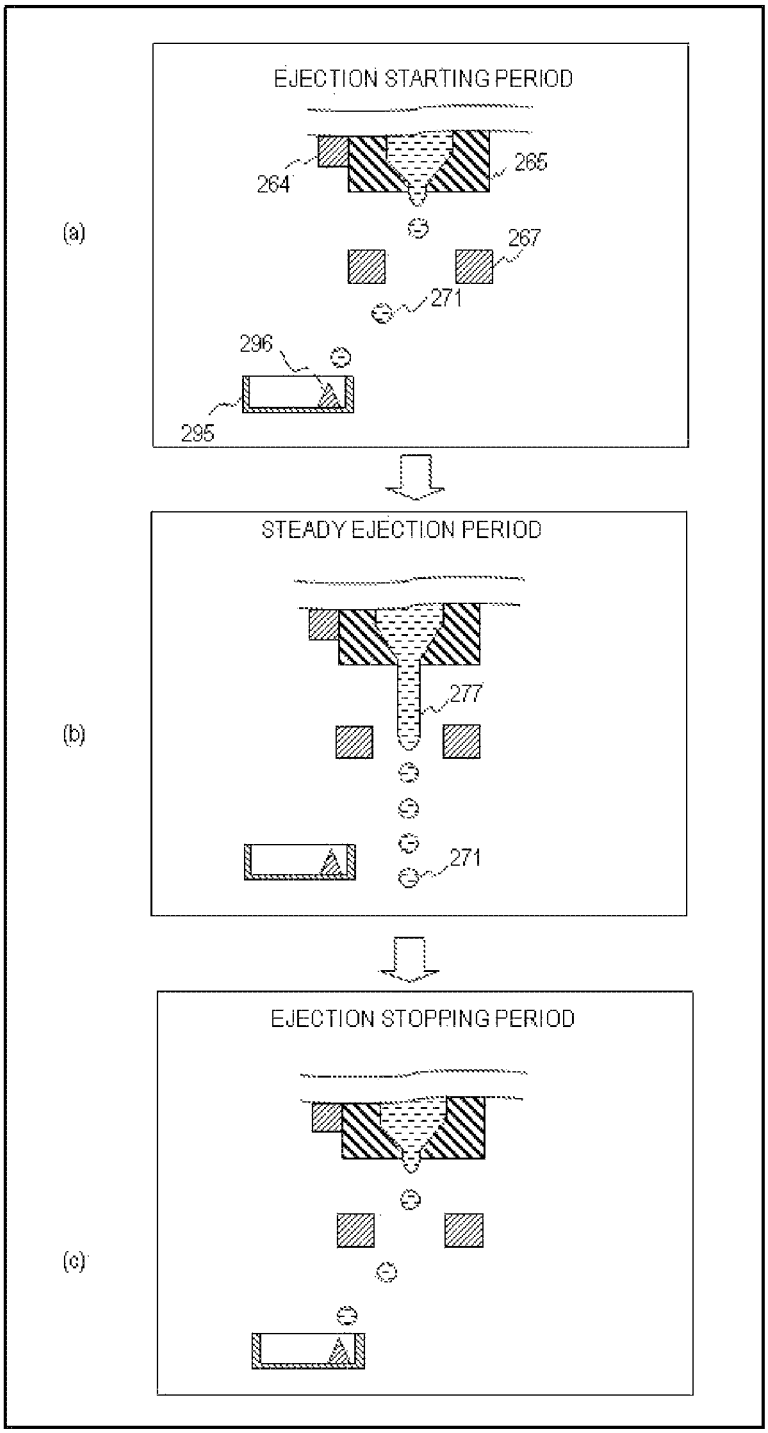
FIG. 15B schematically illustrates of states of ejecting droplets in an ejection starting period, a steady ejection period, and an ejection stopping period.

FIG. 15B schematically illustrates states of ejection of droplets 271 in the ejection starting period, the steady ejection period, and the ejection stopping period. FIG. 15B(a) schematically illustrates a state of ejection of droplets 271 in the ejection starting period. FIG. 15B(b) schematically illustrates a state of ejection of droplets 271 in the steady ejection period. FIG. 15B(c) schematically illustrates a state of ejection of droplets 271 in the ejection stopping period.

As shown in FIGS. 15B(a) and 15B(c), charged droplets 271 may be attracted to the collecting electrode 296 because of the Coulomb attraction in the ejection starting period and the ejection stopping period. The droplets 271 may be collected into the collecting tank 295 containing the collecting electrode 296. Specifically, in each of the period from the start of ejection to the time T2 and the period from the time T5 to the stop of the ejection, all the droplets may be charged and collected.

As shown in FIG. 15B(b), the potential of the collecting electrode 296 may be maintained at 0 V in the steady ejection period; the droplets 271 do not need to be collected into the collecting tank 295.

Upon receipt of a signal to start ejection from a function unit in the EUV light generation controller 5, the target controller 51 may maintain the potential of the charging electrode 267 at V1 with the charging-electrode power supply 516 and maintain the potential of the collecting electrode 296 at V2 with the collecting-electrode power supply 515. The polarities of the potentials V1 and V2 may be the same, for example, negative. The absolute value of the potential V2 may be greater than the absolute value of the potential V1.

Until the pressure in the tank 61 reaches a threshold value Pth, all the produced droplets 271 may be charged positively. The produced droplets 271 may be attracted to the collecting electrode 296 because of the Coulomb force and drop into the collecting tank 295. When the pressure in the tank 61 exceeds Pth, the target controller 51 may change the potentials of both of the charging electrode 267 and the collecting electrode 296 to 0 V.

When the pressure in the tank 61 comes down to the threshold value Pth in response to a signal to stop ejection from a function unit in the EUV light generation controller 5, the target controller 51 may change the potential of the charging electrode 267 to V1 and change the potential of the collecting electrode 296 to V2. All the produced droplets 271 may be charged positively. The produced droplets 271 may be attracted to the collecting electrode 296 because of the Coulomb force and drop into the collecting tank 295. After the pressure in the tank 61 further comes down to a pressure Pmin at which ejection of the target material stop, the target controller 51 may change the potentials of both of the charging electrode 267 and the collecting electrode 296 to 0 V.

Maintaining the potentials of the charging electrode 267 and the collecting electrode 296 at predetermined potentials in the ejection starting period and the ejection stopping period may cause all the produced droplets 271 to be charged and attracted to the collecting electrode 296 because of the Coulomb force. The droplets 271 may be collected into the collecting tank 295. As a result, the droplets 271 may be prevented from dropping onto the surface of the EUV collector mirror.

Collecting of droplets 271 may be enabled only either one of the ejection starting period and the ejection stopping period. Collecting of droplets 271 using the collecting electrode 296 may be used independently from producing target droplets 27 by joining a plurality of droplets 271.

6.2 Configuration Example 2

Figure 16A:
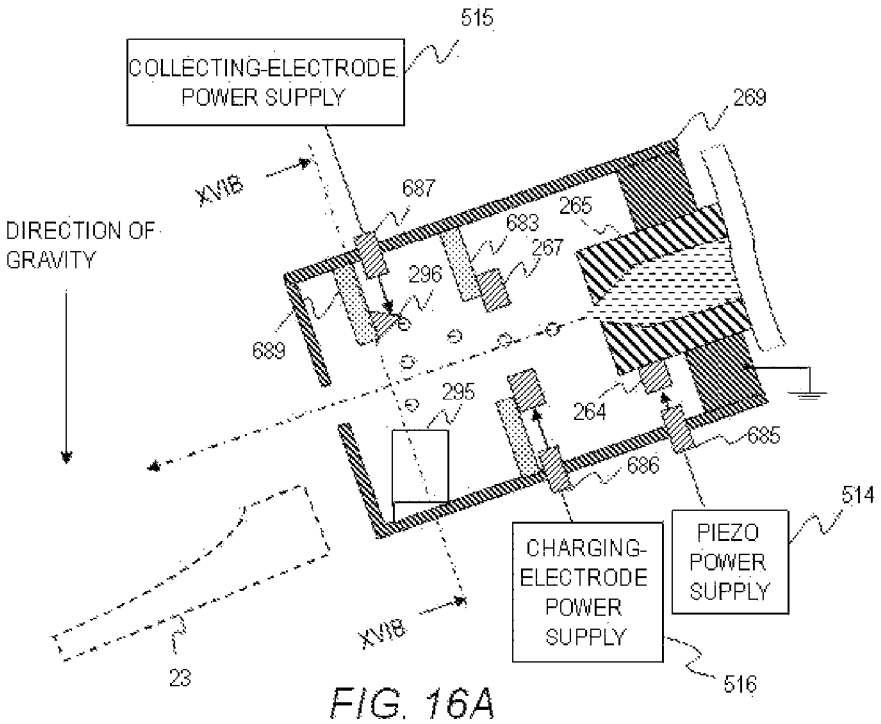
FIG. 16A illustrates another configuration example of a target producing unit including a droplet collecting electrode.
Figure 16B:
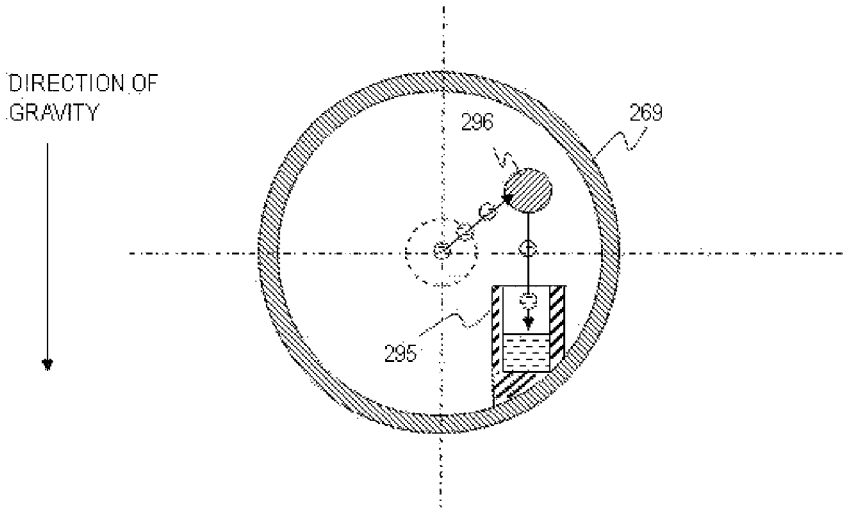
FIG. 16B schematically illustrates a cross-section taken along the XVIB line in FIG. 16A.

FIGS. 16A and 16B illustrate another configuration example of a target producing unit 275 including a droplet collecting tank. FIG. 16B illustrates the cross-section taken along the cut line XVIB in FIG. 16A. In this example, the trajectory of the droplets 271 in the steady ejection period may be tilted with respect to the direction of gravity.

The cover 269 may include a support member 689 for supporting a collecting electrode 296 and a terminal 687 for connecting a collecting-electrode power supply 515 and a collecting electrode 296 with each other. The support member 689 may be made of an electric insulator. For example, the collecting electrode 296 may be disposed at a position upper than the trajectory of the droplets 271 in the steady operating period and oblique to the direction of gravity. The collecting electrode 296 may be made of carbon fiber felt.

The collecting tank 295 may be disposed on the opposite side of the collecting electrode 296 with respect to the trajectory of droplets 271 in the steady operating period. The collecting tank 295 may be disposed inside the cover 269 and at a position distant from the trajectory of the droplets 271 such that the collecting tank 295 will collect the liquid target material dropping from the collecting electrode 296 because of the gravity.

All droplets 271 may be charged with the same polarity by the charging electrode 267 in the ejection starting period and/or the ejection stopping period. Because of the Coulomb force, the charged droplets 271 may be attracted toward the collecting electrode 296 maintained at a positive or negative potential and hit the collecting electrode 296. The liquid target material attached on the collecting electrode 296 may drop into the collecting tank 295 because of the gravity. The collecting tank 295 and the collecting electrode 296 may be heated to a temperature at which the target material may melt.

This configuration example where the trajectory of the droplets in the steady operating period is tilted with respect to the direction the gravity may attract droplets 271 unstable in trajectory to the collecting electrode 296 with the Coulomb force and collects the attracted droplets 271 into the collecting tank 295 in the ejection starting period and/or the ejection stopping period. As a result, the droplets 271 may be prevented from dropping onto the surface of the EUV collector mirror. Since the collecting electrode 296 is disposed at a position upper than the trajectory of the droplets in the steady operating period and oblique to the direction of gravity, prevention of dropping of droplets 271 onto the surface of the EUV collector mirror may be enhanced.

The collecting electrode 296 may be disposed at any position as far as the collecting electrode 296 is away from droplets 271 on the trajectory in the steady operating period. The collecting tank 295 may be disposed outside the cover 269 but inside the chamber 2.

Figure 17:
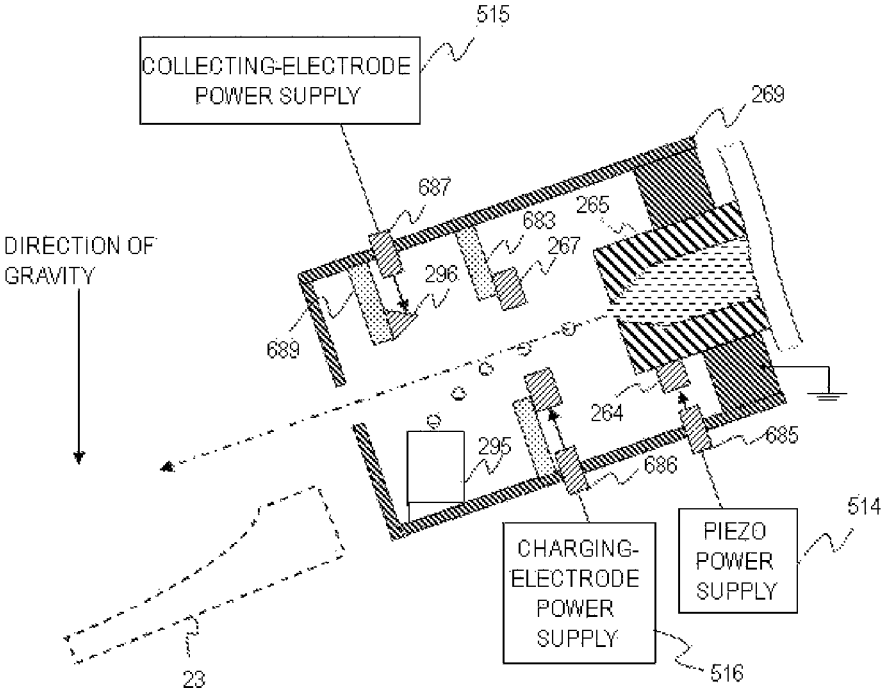
FIG. 17 schematically illustrates another configuration example of a target producing unit including a droplet collecting tank.

As illustrated in FIG. 17, the collecting electrode 296 may be maintained at a potential of the same polarity as the droplets 271 to direct the droplets 271 to the collecting tank 295 with the Coulomb repulsion. This configuration may enable the droplets 271 to be collected into the collecting tank 295 without hitting the collecting electrode 296. The position of the collecting tank 295 is not limited to the position indicated in FIG. 17 but may be on the extension of the trajectory of the droplets directed by the collecting electrode 296.

The target producing unit 275 may direct the droplets 271 with a plurality of collecting electrodes 296. The polarities of the plurality of collecting electrodes 296 may all be in the same polarity or in different polarities. The directing the droplets 271 with repulsion may be applicable to an apparatus having a relation different from the relation of the trajectory of droplets 271 and the direction of gravity in the steady ejection period in FIG. 17.

The foregoing description is merely provided for the purpose of exemplification but not limitation. Accordingly, it is obvious for a person skilled in the art that the embodiments in this disclosure may be modified within the scope of the appended claims.

A part of the configuration of an embodiment may be replaced with a configuration of another embodiment. A configuration of an embodiment may be incorporated to a configuration of another embodiment. A part of the configuration of each embodiment may be removed, added to a different configuration, or replaced by a different configuration.

The terms used in this specification and the appended claims should be interpreted as "non-limiting". For example, the terms "include" and "be included" should be interpreted as "including the stated elements but not limited to the stated elements". The term "have" should be interpreted as "having the stated elements but not limited to the stated elements". Further, the modifier "one (a/an)" should be interpreted as "at least one" or "one or more."

What is claimed is:

1. An extreme ultraviolet light generation apparatus configured to create a target droplet by joining successive droplets and irradiate the target droplet with a pulse laser beam in a plasma generation region to generate extreme ultraviolet light, the extreme ultraviolet light generation apparatus comprising:

a droplet supply device configured to contain a droplet material and successively supply droplets;

a charging electrode disposed between the droplet supply device and the plasma generation region, the charging electrode being configured to control charging of droplets supplied from the droplet supply unit; and a target controller configured to control electric polarities of the droplets supplied from the droplet supply unit by controlling potential of the charging electrode in such a way that successive droplets join together to become a target droplet, wherein the droplets controlled in charging by the charging electrode include a plurality of groups each composed of successive droplets, and, in each of the groups, a droplet at one end is charged positively or negatively, a droplet at the other end is uncharged or charged in a polarity being the same as a polarity of an adjacent droplet in a group adjacent to the droplet at the other end, and the successive droplets join together utilizing a change in speed caused by Coulomb force of the droplet at the one end to become a target droplet, and wherein, in each of the groups, only the droplet at the one end is charged and the other droplets are uncharged.

2. An extreme ultraviolet light generation apparatus configured to create a target droplet by joining successive droplets and irradiate the target droplet with a pulse laser beam in a plasma generation region to generate extreme ultraviolet light, the extreme ultraviolet light generation apparatus comprising:

a droplet supply device configured to contain a droplet material and successively supply droplets;

a charging electrode disposed between the droplet supply device and the plasma generation region, the charging electrode being configured to control charging of droplets supplied from the droplet supply unit; and a target controller configured to control electric polarities of the droplets supplied from the droplet supply unit by controlling potential of the charging electrode in such a way that successive droplets join together to become a target droplet, wherein the droplets controlled in charging by the charging electrode include a plurality of groups each composed of successive droplets, and, in each of the groups, a droplet at one end is charged positively or negatively, a droplet at the other end is uncharged or charged in a polarity being the same as a polarity of an adjacent droplet in a group adjacent to the droplet at the other end, and the successive droplets join together utilizing a change in speed caused by Coulomb force of the droplet at the one end to become a target droplet, and wherein each of the groups includes a positively charged droplet, a negatively charged droplet, and an uncharged droplet and is uncharged as a whole of the group.

3. The extreme ultraviolet light generation apparatus according to claim 1, further comprising a speed-controlling electrode disposed between the charging electrode and the plasma generation region, the speed-controlling electrode being configured to change a speed of a charged droplet.

4. The extreme ultraviolet light generation apparatus according to claim 3, wherein an absolute value of potential of the speed-controlling electrode is greater than an absolute value of potential of the charging electrode.

5. The extreme ultraviolet light generation apparatus according to claim 1, further comprising a pressure adjuster configured to adjust internal pressure of the droplet supply device to eject the droplet material from the droplet supply device, wherein the target controller is configured to maintain the charging electrode at a predetermined potential to charge droplets successively ejected from the droplet supply device in at least one of a first period immediately after the droplet supply device starts ejection of droplets and a second period immediately before the droplet supply device stops the ejection of droplets.

6. The extreme ultraviolet light generation apparatus according to claim 2, wherein the droplet at the other end is charged in a polarity opposite to the polarity of the droplet at the one end.

7. The extreme ultraviolet light generation apparatus according to claim 2, further comprising a speed-controlling electrode disposed between the charging electrode and the plasma generation region, the speed-controlling electrode being configured to change a speed of a charged droplet.

8. The extreme ultraviolet light generation apparatus according to claim 7, wherein an absolute value of potential of the speed-controlling electrode is greater than an absolute value of potential of the charging electrode.

9. The extreme ultraviolet light generation apparatus according to claim 2, further comprising a pressure adjuster configured to adjust internal pressure of the droplet supply device to eject the droplet material from the droplet supply device, wherein the target controller is configured to maintain the charging electrode at a predetermined potential to charge droplets successively ejected from the droplet supply device in at least one of a first period immediately after the droplet supply device starts ejection of droplets and a second period immediately before the droplet supply device stops the ejection of droplets.

* * * * *